US012702172B2

(12) United States Patent
Akao et al.

(10) Patent No.: US 12,702,172 B2
(45) Date of Patent: Aug. 11, 2026

(54) TERMINAL DEVICE, INHALATION DEVICE, AND NON- TRANSITORY COMPUTER READABLE MEDIUM

(71) Applicant: JAPAN TOBACCO INC., Tokyo (JP)

(72) Inventors: Takeshi Akao, Tokyo (JP); Tatsunari Aoyama, Tokyo (JP); Toru Nagahama, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 658 days.

(21) Appl. No.: 17/990,257

(22) Filed: Nov. 18, 2022

(65) Prior Publication Data

US 2023/0084086 A1 Mar. 16, 2023

Related U.S. Application Data

(63) Continuation of application No. PCT/JP2020/046580, filed on Dec. 14, 2020.

(51) Int. Cl.

| | |
|---|---|
| ***G08B 23/00*** | (2006.01) |
| ***A24F 40/57*** | (2020.01) |
| ***A24F 40/65*** | (2020.01) |

(52) U.S. Cl.

CPC ..... *A24F 40/65* (2020.01); *A24F 40/57* (2020.01)

(58) Field of Classification Search

CPC ..... A01B 63/32; A01B 35/16; A01B 63/245
USPC ..... 340/500
See application file for complete search history.

(56) References Cited

U.S. PATENT DOCUMENTS

| | | | | |
|---|---|---|---|---|
| 2014/0195467 | A1 | 7/2014 | Yoshizu | |
| 2017/0013875 | A1* | 1/2017 | Schennum | A24F 40/95 |
| 2017/0042230 | A1* | 2/2017 | Cameron | A24F 40/60 |
| 2017/0112191 | A1* | 4/2017 | Sur | A24F 40/50 |
| 2017/0135405 | A1* | 5/2017 | Reevell | H01C 7/06 |
| 2018/0160733 | A1* | 6/2018 | Leadley | A24F 40/50 |
| 2019/0087302 | A1* | 3/2019 | Smith | A24F 40/65 |
| 2019/0272359 | A1* | 9/2019 | Popplewell | G06F 21/32 |
| 2020/0000143 | A1* | 1/2020 | Anderson | G06F 18/23 |
| 2020/0060347 | A1 | 2/2020 | Kersey et al. | |
| 2020/0106753 | A1 | 4/2020 | Kubo et al. | |
| 2020/0146361 | A1 | 5/2020 | Silver et al. | |

(Continued)

FOREIGN PATENT DOCUMENTS

| | | | |
|---|---|---|---|
| CN | 110446435 | A | 11/2019 |
| JP | 2011-145746 | A | 7/2011 |
| JP | 2012-118876 | A | 6/2012 |

(Continued)

OTHER PUBLICATIONS

International Search Report (PCT/ISA/210) issued in PCT/JP2020/046580, dated Feb. 2, 2021.

(Continued)

*Primary Examiner* — Tai T Nguyen
(74) *Attorney, Agent, or Firm* — Birch Stewart, Kolasch & Birch, LLP

(57) ABSTRACT

A terminal device provided with a communication unit that communicates with an inhalation device for heating a base material containing an aerosol source to generate aerosol, the communication unit transmitting a first log request for requesting transmission of log information that is to be acquired in response to use of the inhalation device by a user and stored in the inhalation device, and receiving the log information.

6 Claims, 7 Drawing Sheets

(56) References Cited

U.S. PATENT DOCUMENTS

| | | | | |
|---|---|---|---|---|
| 2022/0071303 | A1* | 3/2022 | Aradachi | A24F 40/57 |
| 2024/0245137 | A1 | 7/2024 | Yamada et al. | |

FOREIGN PATENT DOCUMENTS

| | | | | |
|---|---|---|---|---|
| JP | 6352272 | B2 | 7/2018 | |
| JP | 2019-33446 | A | 2/2019 | |
| JP | 2019-512245 | A | 5/2019 | |
| WO | WO 2013/030942 | A1 | 3/2013 | |
| WO | WO 2014/060269 | A1 | 4/2014 | |
| WO | WO-2017055799 | A1 * | 4/2017 | H04W 4/021 |
| WO | WO 2017/153594 | A1 | 9/2017 | |
| WO | WO 2019/126805 | A1 | 6/2019 | |
| WO | WO 2020/128448 | A1 | 6/2020 | |

OTHER PUBLICATIONS

Extended European Search Report for European Application No. 20965855.8, dated Oct. 25, 2024.

* cited by examiner

TERMINAL DEVICE, INHALATION DEVICE, AND NON- TRANSITORY COMPUTER READABLE MEDIUM

CROSS REFERENCES TO RELATED APPLICATIONS

This application is a continuation application based on International Patent Application No. PCT/JP2020/046580 filed on Dec. 14, 2020, and the content of the PCT international application is incorporated herein by reference.

TECHNICAL FIELD

The present invention relates to a terminal device, an inhaler device, and a non-transitory computer readable medium.

BACKGROUND ART

Inhaler devices, such as electronic cigarettes and nebulizers, which generate material to be inhaled by a user, are widespread. For example, such an inhaler device generates an aerosol imparted with a flavor component by using a substrate including an aerosol source for generating the aerosol, a flavor source for imparting the flavor component to the generated aerosol, and the like. The user can enjoy the flavor by inhaling the aerosol imparted with the flavor component, which is generated by the inhaler device.

In recent years, it has been studied to provide various services by installing a communication function in an inhaler device and causing the inhaler device to communicate with a smartphone or the like. In terms of installing a wireless communication function in an inhaler device, Patent Literature 1 below discloses a technique for temporarily storing information acquired by the inhaler device and then transmitting the information.

CITATION LIST

Patent Literature

Patent Literature 1: Japanese Patent No. 6352272

SUMMARY OF INVENTION

Technical Problem

However, in the technique described in Patent Literature 1 above, the timing of transmitting the information acquired by the inhaler device has not been studied.

The present invention has been made in view of the above-described problem, and an object of the present invention is to provide a mechanism by which the information acquired by the inhaler device can be transmitted at an appropriate timing.

Solution to Problem

In order to solve the above problem, an aspect of the present invention provides a terminal device including: a communicator that communicates with an inhaler device which heats a substrate containing an aerosol source to generate an aerosol, in which the communicator transmits a first log request for requesting transmission of log information that is acquired in accordance with use of the inhaler device by a user and that is stored in the inhaler device, and receives the log information.

The communicator may receive, from the inhaler device, information indicating a number of pieces of the log information yet to be transmitted, and transmits the first log request.

The communicator may transmit a second log request for requesting transmission of the information indicating the number of pieces of the log information yet to be transmitted, and receive, from the inhaler device, the information indicating the number of pieces of the log information yet to be transmitted.

If the number of pieces of the log information yet to be transmitted is two or more, the communicator may transmit the first log request for requesting transmission of first log information among the plurality of pieces of the log information yet to be transmitted, and, after receiving the first log information, transmit the first log request for requesting transmission of second log information.

A time of acquisition of the first log information in the inhaler device may be earlier than a time of acquisition of the second log information.

The log information may include, as information indicating a time of acquisition of the log information, inhalation start time information indicating a time at which the aerosol is first inhaled in a time segment from a start to an end of a process of generating the aerosol by using the substrate.

The inhaler device may include: an opening through which the substrate is insertable; and a lid that opens and closes the opening, and, after receiving state information including information indicating that the lid has closed the opening, the communicator may transmit the first log request.

After a first predetermined time has elapsed after receiving the state information, the communicator may transmit the first log request.

The communicator may transmit setting information for changing setting regarding an operation of the inhaler device, and, after receiving a setting completion notification indicating that the setting based on the setting information has been completed, transmit the first log request.

After a second predetermined time has elapsed after receiving the setting completion notification, the communicator may transmit the first log request.

The inhaler device may include a heater that heats the substrate containing the aerosol source to generate the aerosol, the heater may operate based on a heating profile defining a time-series transition of a target resistance value, which is a target value of a resistance value of the heater, and the setting information may include information indicating the heating profile.

The log information may include information indicating a number of times the aerosol is inhaled in a time segment from a start to an end of a process of generating the aerosol by using the substrate.

The log information may include information indicating a time at which the aerosol is inhaled in a time segment from a start to an end of a process of generating the aerosol by using the substrate.

The communicator may transfer the log information received from the inhaler device to another device.

In order to solve the above problem, another aspect of the present invention provides an inhaler device including: a communicator that communicates with another device; a heater that heats a substrate containing an aerosol source to generate an aerosol; and a memory that stores log information acquired in accordance with use of the inhaler device by a user, in which, upon receiving a first log request for requesting transmission of the log information, the communicator transmits the log information.

Upon receiving the first log request, the communicator may transmit the log information yet to be transmitted, included in the log information stored in the memory.

The communicator may transmit information indicating a number of pieces of the log information yet to be transmitted.

Upon receiving a second log request for requesting transmission of the information indicating the number of pieces of the log information yet to be transmitted, the communicator may transmit the information indicating the number of pieces of the log information yet to be transmitted.

If the number of pieces of the log information yet to be transmitted is two or more, upon receiving the first log request for requesting transmission of first log information among the plurality of pieces of the log information yet to be transmitted, the communicator may transmit the first log information, and, upon receiving the first log request for requesting transmission of second log information among the plurality of pieces of the log information yet to be transmitted, the communicator may transmit the second log information.

If the number of pieces of the log information yet to be transmitted is two or more, the communicator may transmit the pieces of the log information in an order from a piece with an earliest time of acquisition.

The log information may include, as information indicating a time of acquisition of the log information, inhalation start time information indicating a time at which the aerosol is first inhaled in a time segment from a start to an end of a process of generating the aerosol by using the substrate, and the communicator may transmit the pieces of the log information in an order from a piece with an earliest time indicated by the inhalation start time information.

In order to solve the above problem, another aspect of the present invention provides a non-transitory computer readable medium having a program stored therein, the program for causing a computer to, the computer controlling a terminal device that communicates with an inhaler device which heats a substrate containing an aerosol source to generate an aerosol: control the terminal device to transmit a first log request for requesting transmission of log information that is acquired in accordance with use of the inhaler device by a user and that is stored in the inhaler device, and receive the log information.

Advantageous Effects of Invention

As described above, according to the present invention, a mechanism is provided by which the information acquired by the inhaler device can be transmitted at an appropriate timing is provided.

DESCRIPTION OF EMBODIMENTS

Figure 1:
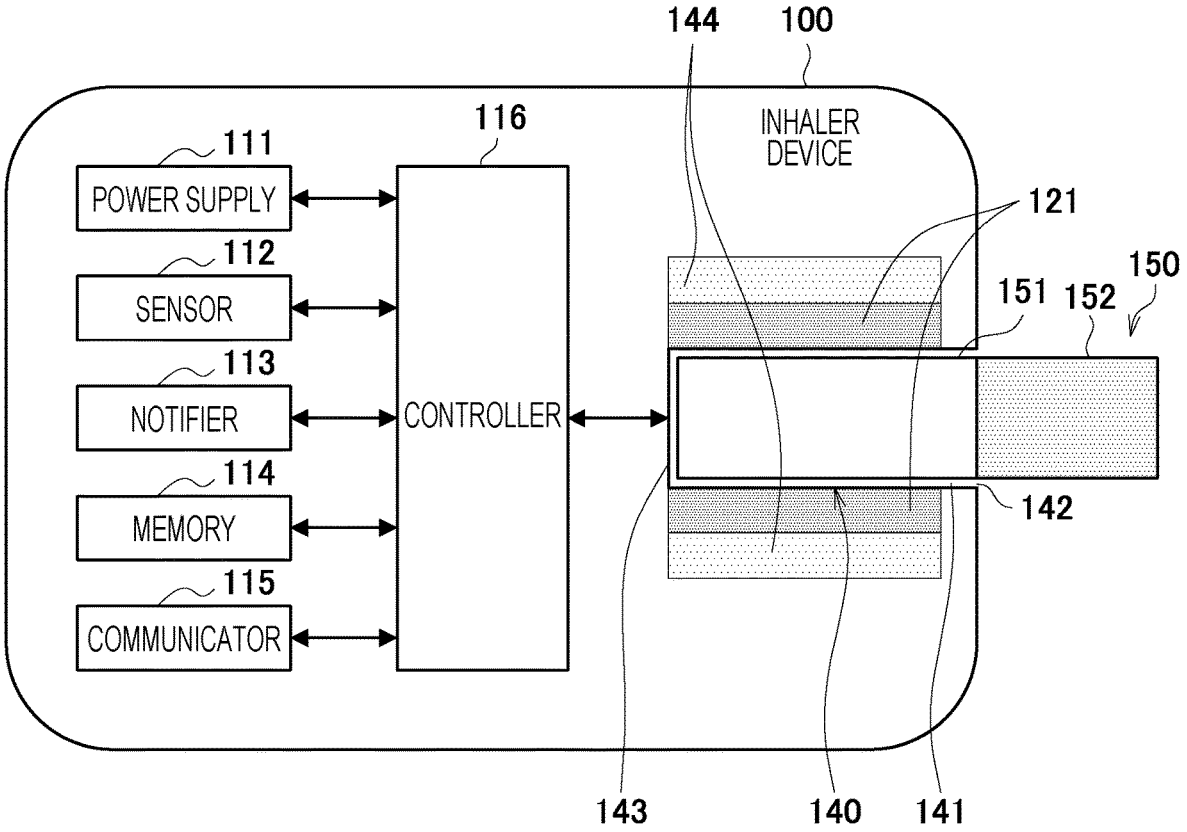
FIG. 1 is a schematic diagram of an internal configuration example of an inhaler device.

Now, preferred embodiments of the present invention will be described in detail with reference to the accompanying drawings. In the specification and the drawings, components having substantially the same function and configuration are denoted by the same reference numerals, and redundant description thereof will be omitted.

<<1. Configuration Example of Inhaler Device>>

An inhaler device generates material to be inhaled by a user. In the following description, the material generated by the inhaler device is an aerosol. Alternatively, the material generated by the inhaler device may be gas.

(1) Internal Configuration Example

FIG. 1 is a schematic diagram of an internal configuration example of the inhaler device. As illustrated in FIG. 1, an inhaler device 100 according to the present configuration example includes a power supply 111, a sensor 112, a notifier 113, a memory 114, a communicator 115, a controller 116, a heater 121, a holder 140, and a heat insulator 144.

The power supply 111 stores electric power. The power supply 111 supplies electric power to the structural elements of the inhaler device 100 under the control of the controller 116. The power supply 111 may be, for example, a rechargeable battery such as a lithium ion secondary battery.

The sensor 112 acquires various kinds of information regarding the inhaler device 100. In an example, the sensor 112 may be a pressure sensor such as a condenser microphone, a flow sensor, a temperature sensor, or the like, and acquire a value generated in accordance with the user's inhalation. In another example, the sensor 112 may be an input device that receives information input by the user, such as a button or a switch.

The notifier 113 provides information to the user. The notifier 113 may be, for example, a light emitting device that emits light, a display device that displays an image, a sound output device that outputs sound, a vibration device that vibrates, or the like.

The memory 114 stores various kinds of information for operation of the inhaler device 100. The memory 114 may be, for example, a non-volatile storage medium such as flash memory.

The communicator 115 is a communication interface capable of communication in conformity with any wired or wireless communication standard. Such a communication standard may be, for example, Wi-Fi (registered trademark), Bluetooth (registered trademark), or the like.

The controller 116 functions as an arithmetic processing device and a control device, and controls the overall operations of the inhaler device 100 in accordance with various programs. The controller 116 includes, for example, an electronic circuit such as a central processing unit (CPU) or a microprocessor.

The holder 140 has an internal space 141, and holds a stick substrate 150 in a manner partially accommodated in the internal space 141. The holder 140 has an opening 142 that allows the internal space 141 to communicate with outside. The holder 140 accommodates the stick substrate 150 that is inserted into the internal space 141 through the opening 142. For example, the holder 140 may be a tubular body having the opening 142 and a bottom 143 on its ends, and may define the pillar-shaped internal space 141. The holder 140 also has a function of defining an airflow path that supplies air to the stick substrate 150. For example, the bottom 143 is provided with an air inlet hole that is an inlet of air into the airflow path. Meanwhile, the opening 142 serves as an air outlet hole that is an outlet of the air from the airflow path.

The stick substrate 150 includes a substrate 151 and an inhalation port 152. The substrate 151 includes an aerosol source. Note that the aerosol source is not limited to a liquid but may also be a solid in the present configuration example. In a state in which the stick substrate 150 is held by the holder 140, the substrate 151 is at least partially accommodated in the internal space 141, and the inhalation port 152 is at least partially protruding from the opening 142. When the user inhales with the inhalation port 152 protruding from the opening 142 in his/her mouth, air flows into the internal space 141 through the air inlet hole (not illustrated), and the air and an aerosol generated from the substrate 151 reach inside the mouth of the user.

The heater 121 heats the aerosol source to atomize the aerosol source and generate the aerosol. In the example illustrated in FIG. 1, the heater 121 has a film-like shape and surrounds the outer circumference of the holder 140. Subsequently, heat produced from the heater 121 heats the substrate 151 of the stick substrate 150 from the outer circumference, generating the aerosol. The heater 121 produces heat when receiving electric power from the power supply 111. In an example, the electric power may be supplied in response to a sensor 112A detecting a start of the user's inhalation and/or an input of predetermined information. Subsequently, the supply of the electric power may be stopped in response to the sensor 112A detecting an end of the user's inhalation and/or an input of predetermined information.

The heat insulator 144 prevents heat from transferring from the heater 121 to the other structural elements. For example, the heat insulator 144 may be a vacuum heat insulator, an aerogel heat insulator, or the like.

The configuration example of the inhaler device 100 has been described above. The configuration of the inhaler device 100 is not limited to the above one, and may be various configurations as exemplified below.

In an example, the heater 121 may have a blade-like shape, and may be disposed so that the heater 121 protrudes from the bottom 143 of the holder 140 toward the internal space 141. In this case, the heater 121 having the blade-like shape is inserted into the substrate 151 of the stick substrate 150 and heats the substrate 151 of the stick substrate 150 from its inside. In another example, the heater 121 may be disposed so that the heater 121 covers the bottom 143 of the holder 140. In still another example, the heater 121 may be implemented as a combination of two or more selected from a first heater that covers the outer circumference of the holder 140, a second heater having the blade-like shape, and a third heater that covers the bottom 143 of the holder 140.

In another example, the holder 140 may include an opening/closing mechanism that partially opens and closes an outer shell defining the internal space 141. Examples of the opening/closing mechanism include a hinge. In addition, the holder 140 may accommodate the stick substrate 150 while sandwiching the stick substrate 150 inserted into the internal space 141 by opening and closing the outer shell. In this case, the heater 121 may be at the sandwiching position of the holder 140 and may produce heat while pressing the stick substrate 150.

In addition, means for atomizing the aerosol source is not limited to heating by the heater 121. For example, the means for atomizing the aerosol source may be induction heating.

(2) Appearance Configuration Example

Figure 2:
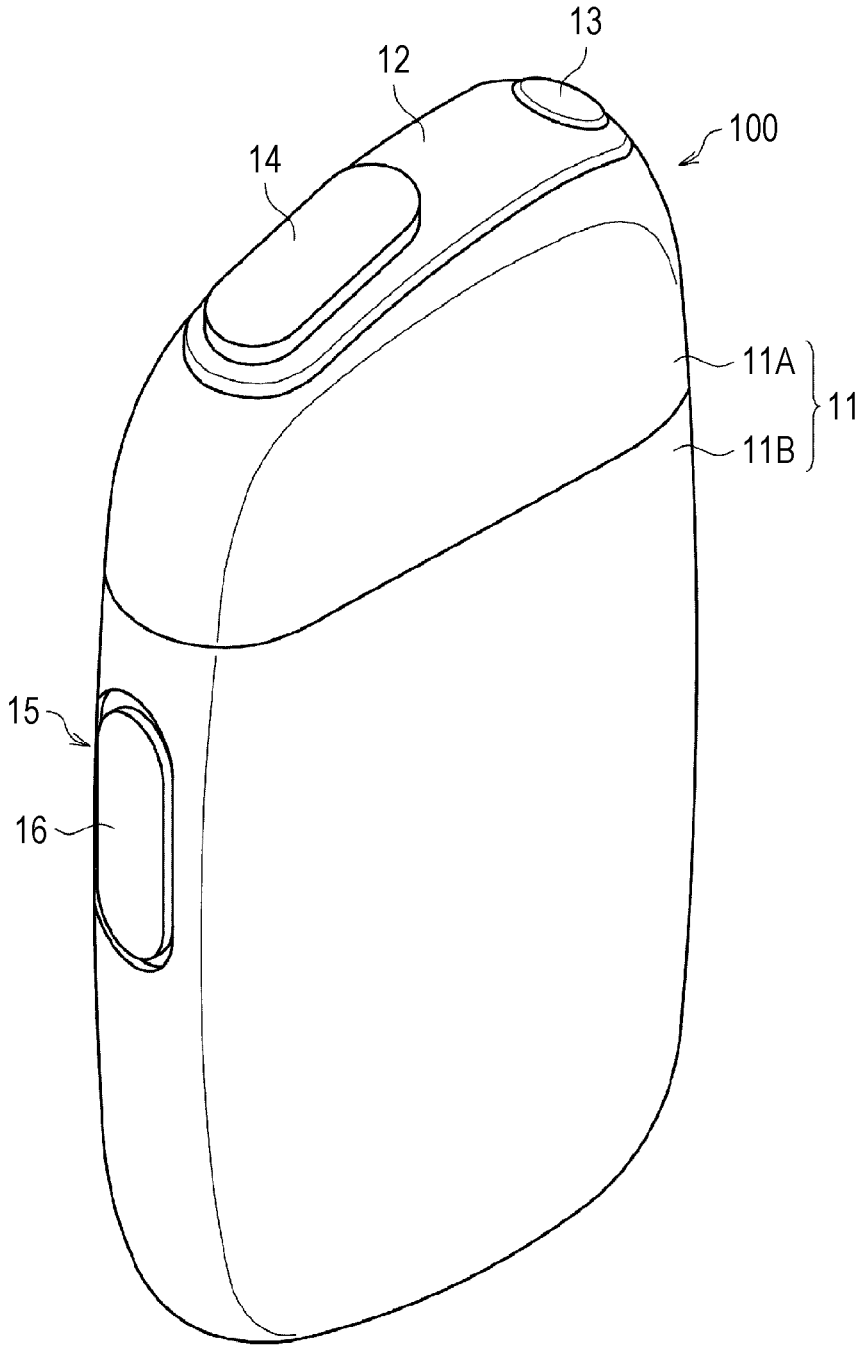
FIG. 2 is an overall perspective view of the inhaler device according to the present embodiment.
Figure 3:
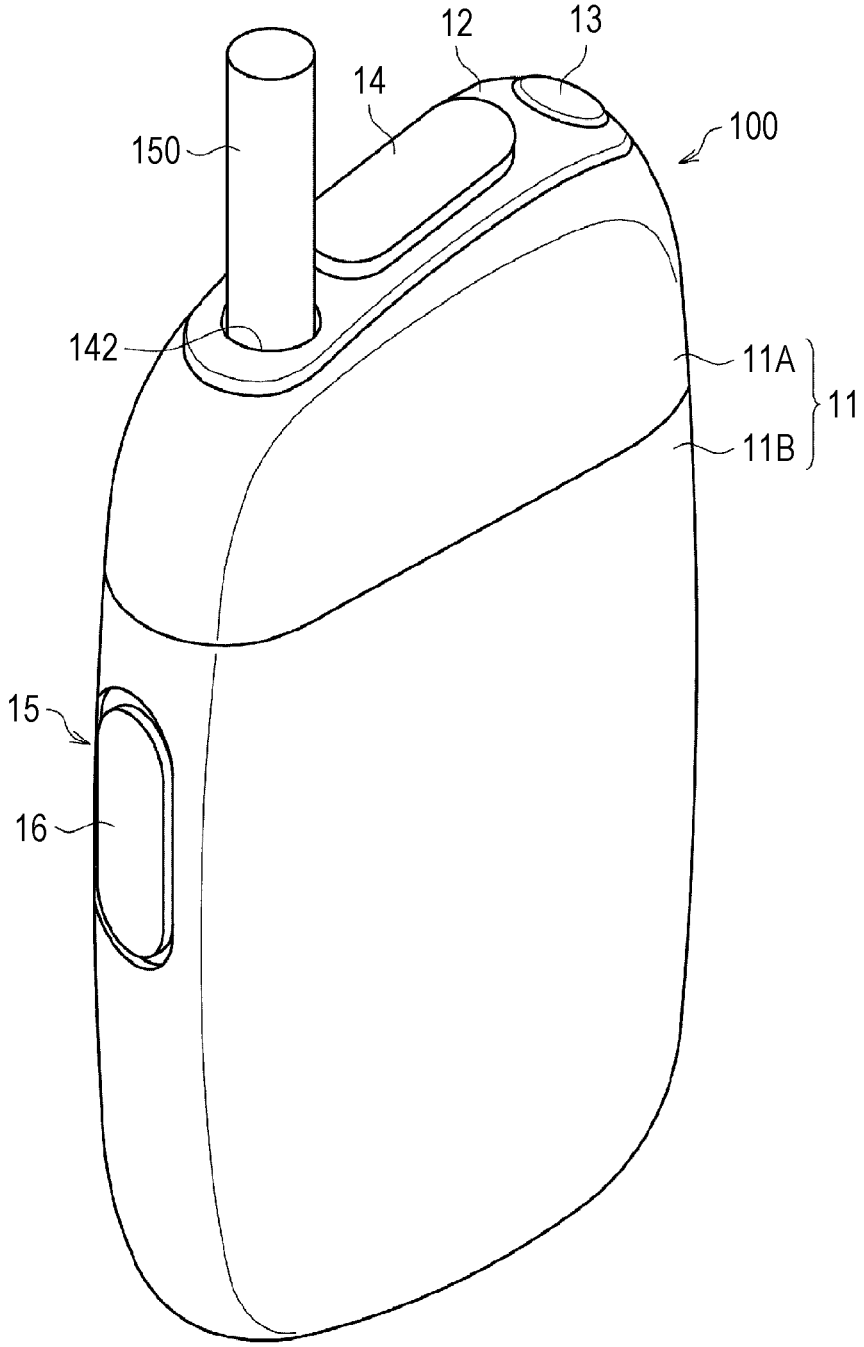
FIG. 3 is an overall perspective view of the inhaler device according to the present embodiment in a state in which a stick substrate is held.

FIG. 2 is an overall perspective view of the inhaler device 100 according to the present embodiment. FIG. 3 is an overall perspective view of the inhaler device 100 according to the present embodiment in a state in which the stick substrate 150 is held.

As illustrated in FIGS. 2 and 3, the inhaler device 100 includes a top housing 11A, a bottom housing 11B, a cover 12, a switch 13, a lid 14, a vent 15, and a cap 16. The top housing 11A and the bottom housing 11B are connected to each other to form an outermost outer housing 11 of the inhaler device 100. The outer housing 11 has such a size to fit in a hand of a user. To use the inhaler device 100, the user can hold the inhaler device 100 with his/her hand and inhale the flavor.

The top housing 11A has an opening (not illustrated), and the cover 12 is coupled to the top housing 11A so as to close the opening. As illustrated in FIG. 3, the cover 12 has the opening 142 through which the stick substrate 150 can be inserted. The lid 14 is configured to open and close the opening 142 of the cover 12. Specifically, the lid 14 is attached to the cover 12 and is configured to be movable along the surface of the cover 12 between a first position at which the lid 14 closes the opening 142 and a second position at which the lid 14 opens the opening 142. Thus, the lid 14 can permit or restrict access of the stick substrate 150 to the inside (the internal space 141 illustrated in FIG. 1) of the inhaler device 100. A state in which the lid 14 is at the second position and the lid 14 opens the opening 142 is hereinafter also referred to as an open state. A state in which the lid 14 is at the first position and the lid 14 closes the opening 142 is hereinafter also referred to as a closed state.

The switch 13 is used to switch on and off the operation of the inhaler device 100. For example, upon the user operating the switch 13 in a state in which the stick substrate 150 is inserted into the internal space 141 from the opening 142 as illustrated in FIG. 3, electric power is supplied from the power supply 111 to the heater 121, and the stick substrate 150 can be heated without burning. Heating the stick substrate 150 generates an aerosol from the aerosol source included in the stick substrate 150, and the aerosol takes in the flavor of the flavor source. The user can inhale the aerosol containing the flavor by inhaling a portion of the stick substrate 150, the portion protruding from the inhaler device 100 (the portion illustrated in FIG. 3, that is, the inhalation port 152).

The vent 15 is a vent for introducing air into the internal space 141. The air taken into the inhaler device 100 from the vent 15 is introduced into the internal space 141 from, for example, the air inlet hole formed at the bottom 143 of the holder 140. The cap 16 is detachably attached to the bottom housing 11B. If the cap 16 is attached to the bottom housing 11B, the vent 15 is formed between the bottom housing 11B and the cap 16. The cap 16 may have, for example, a through-hole, a notch, or the like (not illustrated). In the present specification, the longitudinal direction of the inhaler device 100 refers to a direction in which the stick substrate 150 is inserted through the opening 142. In addition, in the inhaler device 100 in the present specification, a side (for example, the vent 15 side) into which a fluid such as air flows is referred to as an upstream side, and a side (for example, the opening 142 side) from which the fluid flows out is referred to as a downstream side.

<<2. Technical Features>>

(1) System Configuration Example

Figure 4:
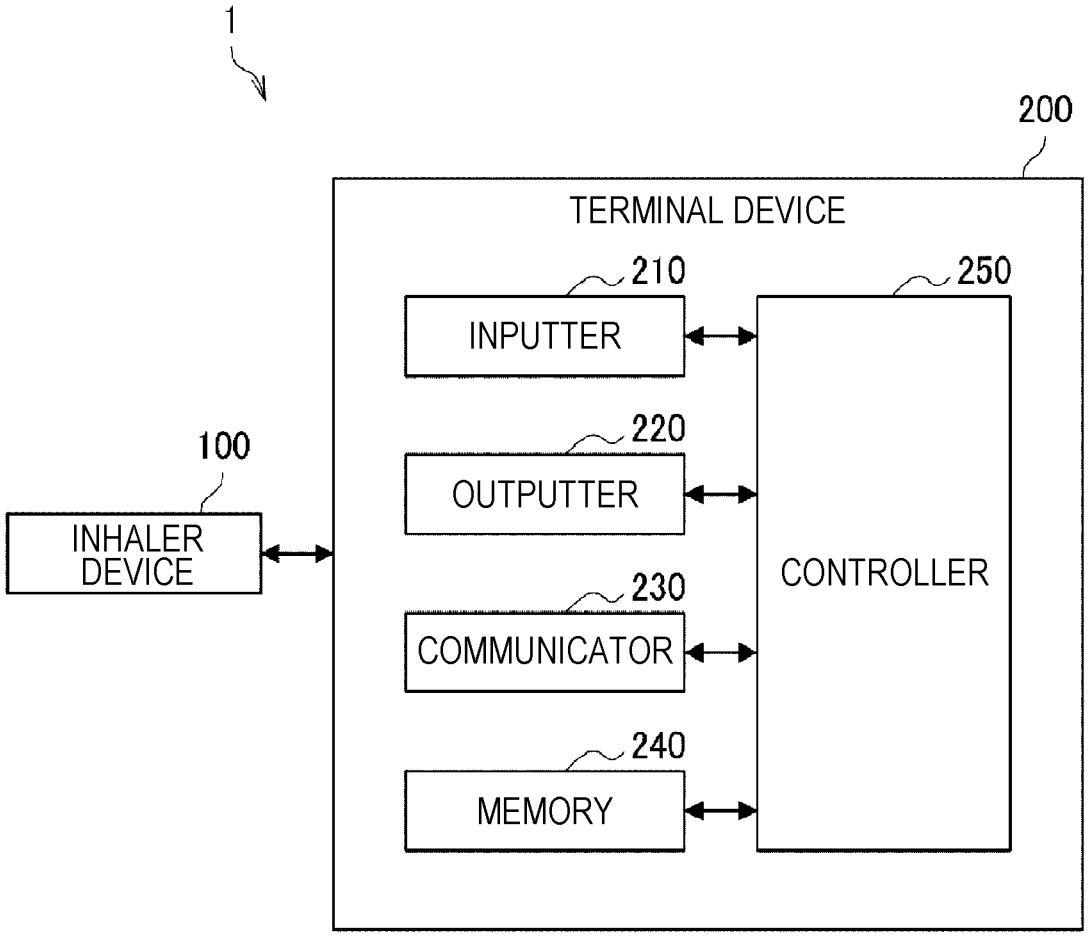
FIG. 4 is a diagram illustrating an example of a configuration of a system according to the present embodiment.

FIG. 4 is a diagram illustrating an example of a configuration of a system 1 according to the present embodiment. As illustrated in FIG. 4, the system 1 includes the inhaler device 100 and a terminal device 200.

Configuration of Inhaler Device 100

The configuration of the inhaler device 100 is as described above. Hereinafter, a user's inhalation of the aerosol generated by the inhaler device 100 is also simply referred to as "inhalation" or "puff". In addition, the user's inhaling action is also referred to as a puff action.

The inhaler device 100 according to the present embodiment generates an aerosol to be inhaled by the user by using the substrate containing the aerosol source. The heater 121 heats the substrate containing the aerosol source to generate the aerosol. The stick substrate 150 is an example of a substrate in the present embodiment.

Configuration of Terminal Device 200

The terminal device 200 is used by the user of the inhaler device 100. For example, the terminal device 200 is configured by any information processing device such as a smartphone, a tablet terminal, or a wearable device. As illustrated in FIG. 4, the terminal device 200 includes an inputter 210, an outputter 220, a communicator 230, a memory 240, and a controller 250.

The inputter 210 has a function of receiving an input of various kinds of information. The inputter 210 may include an input device that receives an input of information from the user. Examples of the input device include a button, a keyboard, a touch panel, and a microphone. The inputter 210 may further include various sensors such as an image sensor.

The outputter 220 has a function of outputting information. The outputter 220 may include an output device that outputs information to the user. Examples of the output device include a display device that displays information, a light emitting device that emits light, a vibration device that vibrates, and a sound output device that outputs sound. An example of the display device is a display. An example of the light emitting device is a light emitting diode (LED). An example of the vibration device is an eccentric motor. An example of the sound output device is a speaker. The outputter 220 outputs information input from the controller 250 to notify the user of the information.

The communicator 230 is a communication interface for transmitting and receiving information between the terminal device 200 and another device. The communicator 230 performs communication in conformity with any wired or wireless communication standard. Examples of the communication standard include wireless local area network (LAN), wired LAN, Wi-Fi (registered trademark), Bluetooth (registered trademark), and the like.

The memory 240 stores various kinds of information for operation of the terminal device 200. The memory 240 may be, for example, a non-volatile storage medium such as flash memory.

The controller 250 functions as an arithmetic processing device or a control device, and controls the overall operations of the terminal device 200 in accordance with various programs. The controller 250 is implemented by, for example, an electronic circuit such as a central processing unit (CPU) or a microprocessor. The controller 250 may further include a read only memory (ROM) that stores programs to be used, calculation parameters, and the like, and a random access memory (RAM) that temporarily stores parameters and the like that change as appropriate. Under the control of the controller 250, the terminal device 200 performs various kinds of processing. Examples of the processing controlled by the controller 250 include processing of information input by the inputter 210, output of information by the outputter 220, transmission and reception of information by the communicator 230, and storing and reading of information by the memory 240. The controller 250 also controls other processing performed by the terminal device 200, such as input of information to each component and processing based on information output from each component.

Functions of the controller 250 may be implemented by using an application. The application may be pre-installed or may be downloaded. In addition, functions of the controller 250 may be implemented by progressive web apps (PWA).

Device-to-Device Communication

The inhaler device 100 is capable of communicating with other devices. A wireless or wired communication link may be used for communication between the inhaler device 100 and another device. A wireless communication link is employed in the description of the present specification.

In particular, the inhaler device 100 establishes a connection with the other paired device, and transmits and receives information. Pairing is a process of exchanging and storing information of each other between two devices. An example of the information to be exchanged is identification information of a partner, such as a service set identifier (SSID) and information related to an encryption key used for encryption of information to be transmitted and received.

The inhaler device 100 and the terminal device 200 first perform pairing, and then transmit and receive information. The wireless communication standard used for wireless communication between the inhaler device 100 and the terminal device 200 is desirably a short-range wireless communication standard, such as Bluetooth. In this case, if the inhaler device 100 and the terminal device 200 are located within a range in which short-range wireless communication is possible, a connection can be established, and communication can be performed. Hereinafter, it is assumed that the inhaler device 100 and the terminal device 200 perform communication in conformity with Bluetooth Low Energy (BLE) (registered trademark).

The connection between the inhaler device 100 and the terminal device 200 may be established if a predetermined condition is satisfied. An example of the predetermined condition is that the state of the lid 14 is changed to the open state. Another example of the predetermined condition is that charging of the power supply 111 starts. If the inhaler device 100 is connected to an external power supply via, for example, a universal serial bus (USB) or the like, the inhaler device 100 starts charging of the power supply 111. If any one of these predetermined conditions is satisfied, the inhaler device 100 starts transmission of an advertisement, establishes a connection with the terminal device 200 that has received the advertisement, and starts transmission and reception of information.

The connection between the inhaler device 100 and the terminal device 200 may be disconnected if a predetermined condition is satisfied. An example of the predetermined condition is that the state of the lid 14 is changed to the closed state. Another example of the predetermined condition is that charging of the power supply 111 ends. For example, the inhaler device 100 ends charging of the power supply 111 if, for example, the connection with the external power supply is released. For example, the inhaler device 100 disconnects the connection with the terminal device 200 if any one of these predetermined conditions is satisfied, an operation performed by the user is not detected for a predetermined time or more, and information is not transmitted and received.

(2) Setting Information

The terminal device 200 can set the operation of the inhaler device 100. For example, the terminal device 200 displays a setting screen for setting the operation of the inhaler device 100. The setting screen displays current setting details of the inhaler device 100 and receives an input of information for changing the setting details. The terminal device 200 generates setting information based on information input by the user and transmits the setting information to the inhaler device 100.

The setting information is information for performing setting regarding the operation of the inhaler device 100. The inhaler device 100 receives the setting information from the terminal device 200. Then, the inhaler device 100 performs setting based on the received setting information and operates according to the setting. Typically, the setting information is information for changing the setting of the inhaler device 100, and the inhaler device 100 changes the setting based on the received setting information. According to such a configuration, the user can perform desired setting on the inhaler device 100 via the terminal device 200.

While the setting information is being transmitted, the terminal device 200 may display information indicating the progress of transmission. For example, the terminal device 200 may display a progress bar in which the degree of progress increases from 0 percent to 100 percent according to the amount of transmitted data from the start to the end of the transmission of the setting information. According to such a configuration, the user can grasp the progress regarding the transmission of the setting information.

Upon completing the setting based on the setting information, the inhaler device 100 transmits a setting completion notification to the terminal device 200. The setting completion notification indicates that the setting has been completed. Upon receiving the setting completion notification, the terminal device 200 may display a screen indicating that the setting of the inhaler device 100 has been completed. According to such a configuration, the user can grasp that the inhaler device 100 has completed the setting based on the setting information.

Upon receiving the setting completion notification, the terminal device 200 outputs information indicating the changed setting. For example, after displaying a screen indicating that the setting of the inhaler device 100 has been completed, the terminal device 200 displays a setting screen reflecting the changed setting. According to such a configuration, the user can grasp the changed setting.

(3) Setting of Communication Function

The setting information may include information indicating whether to validate a communication function of the inhaler device 100. In other words, the setting information may include information indicating whether to permit the communicator 115 to perform communication. The inhaler device 100 validates or invalidates the communication function based on the received setting information. In a case where the communication function is valid, the communicator 115 can communicate with the terminal device 200. In a case where the communication function is invalid, the communicator 115 does not communicate with the terminal device 200. According to such a configuration, the user can switch between validating/invalidating the communication function of the inhaler device 100.

In a case where the communication function is invalid, the inhaler device 100 may validate the communication function if a predetermined condition is satisfied. An example of the predetermined condition is that an operation corresponding to a predetermined operation pattern has been performed. The operation pattern will be described in detail later. If a predetermined condition is satisfied, the inhaler device 100 starts transmission of an advertisement, establishes a connection with the terminal device 200 that has received the advertisement, and starts transmission and reception of information.

(4) Heating Profile

The inhaler device 100 controls the operation of the heater 121 based on a heating profile. The heating profile is information indicating a time-series transition of a target value of a parameter related to the operation of the heater 121. An example of the parameter is the temperature of the heater 121. In this case, the heating profile is information defining a time-series transition of a target temperature, which is a target value of the temperature of the heater 121. The inhaler device 100 controls the temperature of the heater 121 so that the time-series transition of the actual temperature of the heater 121 (hereinafter, also referred to as an actual temperature) becomes substantially the same as the time-series transition of the target temperature defined in the heating profile. This produces an aerosol as planned by the heating profile. The heating profile is typically designed to optimize the flavor enjoyed by the user when the user inhales the aerosol generated from the stick substrate 150. Therefore, by controlling the operation of the heater 121 based on the heating profile, it is possible to optimize the flavor enjoyed by the user.

The controller 116 controls the operation of the heater 121 based on the deviation between the target temperature defined in the heating profile and the actual temperature of the heater 121. More specifically, the controller 116 controls the temperature of the heater 121 based on the deviation between the target temperature and the actual temperature corresponding to the elapsed time from the start of control of the operation of the heater 121 based on the heating profile. The temperature of the heater 121 can be controlled by, for example, known feedback control. Specifically, the controller 116 causes electric power from the power supply 111 to be supplied to the heater 121 in the form of pulses by pulse width modulation (PWM) or pulse frequency modulation (PFM). In this case, the controller 116 can control the temperature of the heater 121 by adjusting a duty ratio of the electric power pulse.

In the feedback control, the controller 116 may control the electric power supplied to the heater 121, based on the difference between the actual temperature and the target temperature. The controller 116 may control, for example, the above-described duty ratio. The feedback control may be, for example, proportional-integral-differential controller (PID controller). Alternatively, the controller 116 may perform simple ON-OFF control. For example, the controller 116 may cause the heater 121 to produce heat until the actual temperature reaches the target temperature, cause the heater 121 to stop producing heat if the actual temperature reaches the target temperature, and cause the heater 121 to produce heat again if the actual temperature becomes lower than the target temperature.

In an example, the temperature of the heater 121 can be quantified by measuring or estimating a resistance value (more accurately, an electric resistance value) of the heater 121 (more accurately, a heating resistor constituting the heater 121). This is because the resistance value of the heating resistor changes according to the temperature. The resistance value of the heating resistor can be estimated, for example, by measuring a voltage drop amount in the heating resistor. The voltage drop amount in the heating resistor can be measured by a voltage sensor that measures the potential difference applied to the heating resistor. In another example, the temperature of the heater 121 may be measured by a temperature sensor installed near the heater 121.

As described above, if the resistance value of the heater 121 changes according to the temperature of the heater 121, it can be said that the temperature of the heater 121 has the same meaning as the resistance value of the heater 121. Therefore, the target temperature of the heater 121 can also be indicated by the resistance value of the heater 121. That is, another example of the parameter in the heating profile is the resistance value of the heater 121 corresponding to the target temperature. In this case, the heating profile is information defining a time-series transition of a target resistance value, which is a target value of the resistance value of the heater 121. The inhaler device 100 controls the resistance value of the heater 121 so that the time-series transition of the actual temperature of the heater 121 becomes substantially the same as the time-series transition of the target resistance value defined in the heating profile. The resistance value of the heater 121 can be controlled by, for example, known feedback control. Specifically, the controller 116 causes the electric power from the power supply 111 to be supplied to the heater 121 in the form of pulses by pulse width modulation (PWM) or pulse frequency modulation (PFM). In this case, the controller 116 can control the resistance value of the heater 121 by adjusting the duty ratio of the electric power pulse. According to such a configuration, the actual temperature of the heater 121 can be changed in the same manner as in a case where the heating profile defines the time-series transition of the target temperature.

Note that the temperature of the heater 121 has a correspondence relationship with the resistance value of the heater 121, but the resistance value corresponding to the temperature of the heater 121 depends on the characteristics and the environmental temperature of the heater 121. Therefore, if the characteristics or the environmental temperature of the heater 121 differs, the target resistance value corresponding to the target temperature becomes a different value even if the temperature is the same.

Hereinafter, a time segment from the start to the end of the process of generating an aerosol by using the stick substrate 150, more specifically, a time segment during which the heater 121 operates based on the heating profile, is also referred to as a heating session. The start of the heating session is a start timing of heating based on the heating profile. The end of the heating session is a timing at which a sufficient amount of aerosol is no longer generated. The heating session consists of a first-half pre-heating period and a second-half puffing-allowed period. The puffing-allowed period is a period during which a sufficient amount of aerosol is assumed to be generated. The pre-heating period is a period from the start of heating to the start of the puffing-allowed period. The heating performed during the pre-heating period is also referred to as pre-heating.

The heating session may include a period during which electric power is not supplied to the heater 121. As an example, the heating profile may include an interval during which the temperature of the heater 121 is temporarily lowered, and during the interval, electric power supply to the heater 121 may be stopped. As another example, electric power supply to the heater 121 may be stopped a predetermined time before the end of the puffing-allowed period, that is, a predetermined time before the end of the heating session. Even during a period in which electric power is not supplied to the heater 121, a sufficient amount of aerosol is generated by remaining heat of the heater 121 and the stick substrate 150.

The user may be notified of the start timing and the end timing of the puffing-allowed period. The user may also be notified of a timing that is a predetermined time before the end of the puffing-allowed period (for example, a timing of stopping electric power supply to the heater 121). In this case, the user can puff during the puffing-allowed period with reference to the notification.

It is assumed that one or more puffs will be taken during the heating session, more specifically, during the puffing-allowed period.

The inhaler device 100 may stop heating if the number of puffs taken by the user after the start of heating of the stick substrate 150 reaches a predetermined upper limit value. That is, the heating session may be interrupted if the number of puffs detected during the heating session (more specifically, during the puffing-allowed period) reaches the predetermined upper limit value. The predetermined upper limit value is set to a value corresponding to the number of puffs at which the aerosol source is expected to run out. According to such a configuration, it is possible to prevent the occurrence of a situation in which, although the aerosol source runs out early due to a large number of puffs, heating based on the heating profile is continued and a coarse flavor is delivered to the user.

The setting information may include information indicating the heating profile. In this case, the controller 116 controls the operation of the heater 121 based on the heating profile indicated by the received information. According to such a configuration, the user can set a desired heating profile on the inhaler device 100.

The setting information may include information indicating the above-described predetermined upper limit value on the number of puffs for the heating session. In this case, if the number of puffs detected during the heating session reaches the upper limit value indicated by the received information, the controller 116 stops heating by the heater 121. According to such a configuration, the user can set a desired predetermined upper limit value on the inhaler device 100.

(5) Operation Pattern

The inhaler device 100 includes an operation part that receives a physical operation performed by the user. The operation part is an example of the sensor 112, and detects various operations performed by the user. Hereinafter, a combination of operations on the operation part is also referred to as an operation pattern. The setting information may include information indicating the operation pattern. According to such a configuration, the user can set a desired operation pattern on the inhaler device 100.

The controller 116 sets the operation pattern indicated by the received setting information, and controls the operation of the heater 121 according to the set operation pattern. As an example, if an operation corresponding to the set operation pattern is performed, the controller 116 starts heating by the heater 121. A plurality of combinations of an operation pattern and a process to be performed if an operation corresponding to the operation pattern is performed may be set. In this case, the controller 116 performs a process combined with an operation pattern corresponding to an operation performed on the inhaler device 100 among a plurality of set operation patterns. According to such a configuration, the user can control the operation of the heater 121 by using the desired operation pattern.

The operation part may include a button for receiving a pressing operation performed by the user. An example of such a button is the switch 13. In this case, the operation pattern includes an operation of pressing the switch 13. The operation of pressing the switch 13 may be classified into a short press in which the switch 13 is pressed for a short time before being released and a long press in which the switch 13 is pressed for a long time before being released. An example of the operation pattern is an operation of performing two short presses and then performing one long press. The information indicating the operation pattern included in the setting information includes information indicating a time-series transition of the state of the switch 13. The time-series transition of the state of the switch 13 is a time-series transition as to whether the switch 13 is in the pressed state or in the non-pressed state. Therefore, the number of times and timing (that is, order and interval) of the short press and the long press, the duration of the long press, and the like are set as the operation pattern by the setting information. According to such a configuration, the user can set a desired operation pattern regarding the switch 13 on the inhaler device 100.

An example of the operation part is the lid 14. In this case, the operation pattern includes an operation of opening and closing the opening 142 by the lid 14. An example of the operation pattern is an operation of opening, closing, and opening the opening 142 by the lid 14. The information indicating the operation pattern included in the setting information includes information indicating a time-series transition of the state of the lid 14. The time-series transition of the state of the lid 14 is a time-series transition as to whether the state of the lid 14 is the open state or the closed state. Therefore, the number of times and timing (that is, order and interval) of the operation of bringing the lid 14 into the open state and the operation of bringing the lid 14 into the closed state are set as the operation pattern by the setting information. According to such a configuration, the user can set a desired operation pattern regarding the lid 14 on the inhaler device 100.

The operation pattern may be a combination of an operation of pressing the switch 13 and an operation of opening and closing the opening 142 with the lid 14. An example of the operation pattern is an operation of opening the opening 142 by the lid 14, and then performing two short presses on the switch 13 and then one long press thereon. The information indicating the operation pattern included in the setting information includes information indicating a time-series transition of the state of the switch 13 and the lid 14. According to such a configuration, the user can set a desired operation pattern regarding the switch 13 and the lid 14 on the inhaler device 100. Note that the operation pattern is not limited to the operation of pressing the switch 13 and the operation of opening and closing the opening 142 by the lid 14, and may include an operation of attaching and detaching a front panel (not illustrated), which is detachably attached to the inhaler device 100, or an operation of starting charging of the power supply 111, which is a rechargeable battery such as a lithium ion secondary battery.

(6) Lock Function

The inhaler device 100 has a lock function. The lock function is a function of controlling whether it is possible to perform heating by the heater 121. To prohibit heating by the heater 121 is also referred to as "set a lock". Hereinafter, to permit heating by the heater 121 is also referred to as "release the lock".

In a case where a user operation of giving an instruction to start heating is performed in the lock-released state, the inhaler device 100 starts heating by the heater 121. An example of the operation of giving an instruction to start heating is pressing the switch 13. On the other hand, in a case where a user operation of giving an instruction to start heating is performed in the locked state, the inhaler device 100 does not start heating by the heater 121. According to such a configuration, even if, for example, the switch 13 is erroneously pressed in a bag in the locked state, heating by the heater 121 is not started. Therefore, safety regarding use of the inhaler device 100 can be improved.

First Lock Function

The operation pattern may be set for a first lock function for controlling whether it is possible to perform heating by the heater 121 in accordance with an operation performed by the user. In a case where the first lock function is valid, if an operation corresponding to the operation pattern set for the first lock function is performed, the controller 116 permits heating by the heater 121. On the other hand, in a case where the first lock function is valid, unless the operation corresponding to the operation pattern set for the first lock function is performed, the controller 116 prohibits heating by the heater 121. The user can perform the operation corresponding to the operation pattern set for the first lock function to release the lock by the first lock function. In the lock-released state, for example, if the switch 13 is pressed, heating by the heater 121 is started.

According to such a configuration, unless the operation corresponding to the operation pattern set for the first lock function is performed, the lock is not released. Therefore, misuse by a person other than the user, such as a child, can be prevented. Accordingly, safety regarding use of the inhaler device 100 can be improved.

After the lock by the first lock function has been released, the lock may be set again if a predetermined condition is satisfied. An example of the predetermined condition is that, after the end of heating by the heater 121, the stick substrate 150 is pulled out, and the state of the lid 14 is changed to the closed state. Another example of the predetermined condition is that the operation corresponding to the operation pattern set for the first lock function is performed again.

The setting information may include information indicating whether to validate the first lock function. In this case, the controller 116 validates or invalidates the first lock function based on the setting information. For example, if the setting information includes information indicating validation of the first lock function, the controller 116 validates the first lock function. In this case, unless the operation corresponding to the operation pattern set for the first lock function is performed, the lock is not released. On the other hand, if the setting information includes information indicating invalidation of the first lock function, the controller 116 invalidates the first lock function. In this case, since the lock by the first lock function is not set, the user can start heating by the heater 121 only by pressing the switch 13.

According to such a configuration, by validating the first lock function only in a case where misuse by a child is assumed, such as a case where the user is at home, safety can be increased. On the other hand, by invalidating the first lock function in a case where misuse by a child is not assumed, such as a case where the user is at work, it is possible to reduce the time and effort for performing a lock-releasing operation and to improve usability.

Second Lock Function

The communication state of the communicator 115 may be used for a second lock function for controlling whether it is possible to perform heating by the heater 121 in accordance with the communication state of the communicator 115. In a case where the second lock function is valid, if the communicator 115 is communicating with the terminal device 200, the controller 116 permits heating by the heater 121. On the other hand, in a case where the second lock function is valid, unless the communicator 115 is communicating with the terminal device 200, the controller 116 prohibits heating by the heater 121. An example of the communicator 115 communicating with the terminal device 200 is that a connection based on a short-range wireless communication standard, such as Bluetooth, is established between the inhaler device 100 and the terminal device 200. The user can establish the connection based on the short-range wireless communication standard between the inhaler device 100 and the terminal device 200 to release the lock by the second lock function. In the lock-released state, for example, if the switch 13 is pressed, heating by the heater 121 is started.

According to such a configuration, the lock is released only if the inhaler device 100 and the terminal device 200 are located within a range in which short-range wireless communication is possible and are communicating with each other, and the lock is not released otherwise. Therefore, if the user goes out carrying the terminal device 200, for example, misuse of the inhaler device 100 left at home by a child can be prevented. Accordingly, safety regarding use of the inhaler device 100 can be improved. On the other hand, if the user uses the inhaler device 100 while carrying the terminal device 200, the lock is automatically released. Therefore, it is possible to reduce the time and effort for performing a lock-releasing operation and to improve usability.

The setting information may include information indicating whether to validate the second lock function. In this case, the controller 116 validates or invalidates the second lock function based on the setting information. For example, if the setting information includes information indicating validation of the second lock function, the controller 116 validates the second lock function. In this case, unless the inhaler device 100 and the terminal device 200 are communicating with each other, the lock is not released. On the other hand, if the setting information includes information indicating invalidation of the second lock function, the controller 116 invalidates the second lock function. In this case, since the lock by the second lock function is not set, the user can start heating by the heater 121 only by pressing the switch 13 regardless of whether the inhaler device 100 and the terminal device 200 are communicating with each other.

According to such a configuration, since it is possible to arbitrarily switch between validating and invalidating the second lock function, usability can be improved.

Third Lock Function

The state of the lid 14 is used for a third lock function for controlling whether it is possible to perform heating by the heater 121 in accordance with the state of the lid 14. In a case where the third lock function is valid, if the state of the lid 14 is the open state, the controller 116 permits heating by the heater 121. On the other hand, in a case where the third lock function is valid, if the state of the lid 14 is the closed state, the controller 116 prohibits heating by the heater 121. If the state of the lid 14 is the closed state, at least the stick substrate 150 is not inserted into the inhaler device 100. Therefore, heating in a case where the state of the lid 14 is the closed state causes so-called dry burning in which heating is performed even though the stick substrate 150 is not inserted. In this respect, according to the third lock function, dry burning can be prevented.

From the viewpoint of preventing dry burning, it is desirable that the third lock function be always valid. Of course, the setting information may include information indicating whether to validate the third lock function, and, based on the setting information, whether to validate the third lock function may be switched.

Use of Plurality of Lock Functions in Combination

A plurality of lock functions may be used in combination. For example, the first lock function, the second lock function, and the third lock function described above may be used in combination.

The lock-releasing conditions defined for the first lock function and the second lock function may constitute an OR condition (i.e., logical sum). That is, the lock may be released if either the lock-releasing condition defined for the first lock function or the lock-releasing condition defined for the second lock function is satisfied. In addition, the lock may not be released if neither the lock-releasing condition defined for the first lock function nor the lock-releasing condition defined for the second lock function is satisfied. Specifically, in a case where the first lock function and the second lock function are valid, if the operation corresponding to the operation pattern set for the first lock function is performed, or if the communicator 115 is communicating with the terminal device 200, the controller 116 permits heating by the heater 121. On the other hand, if the operation corresponding to the operation pattern set for the first lock function is not performed and if the communicator 115 is not communicating with the terminal device 200, the controller 116 prohibits heating by the heater 121. According to such a configuration, since the lock can be released by either one of the first lock function and the second lock function, usability can be improved.

Furthermore, the above-described OR condition related to the first lock function and the second lock function and the lock-releasing condition defined for the third lock function may constitute an AND condition (i.e., logical product). That is, the lock may be released if the lock-releasing condition defined for the third lock function is satisfied and if either the lock-releasing condition defined for the first lock function or the lock-releasing condition defined for the second lock function is satisfied. In addition, the lock may not be released if the lock-releasing condition defined for the third lock function is not satisfied, or if neither the lock-releasing condition defined for the first lock function nor the lock-releasing condition defined for the second lock function is satisfied. Specifically, in a case where the first lock function, the second lock function, and the third lock function are valid, if the state of the lid 14 is the open state and if the operation corresponding to the operation pattern set for the first lock function is performed or the communicator 115 is communicating with the terminal device 200, the controller 116 permits heating by the heater 121. On the other hand, if the state of the lid 14 is the closed state, or if the operation corresponding to the operation pattern set for the first lock function is not performed and the communicator 115 is not communicating with the terminal device 200, the controller 116 prohibits heating by the heater 121. According to such a configuration, since the lock can be released by either one of the first lock function and the second lock function while dry burning is prevented, safety can be ensured, and also, usability can be improved.

(7) Battery Information

The inhaler device 100 transmits battery information, which is information indicating the state of the power supply 111 that stores and supplies electric power for the operation of the inhaler device 100. According to such a configuration, the terminal device 200 can grasp the state of the power supply 111 based on the battery information.

The battery information may include information indicating the remaining amount of electric power of the power supply 111. The information indicating the remaining amount of electric power of the power supply 111 is, as an example, information indicating the ratio of the remaining amount with respect to the maximum value of electric power that can be stored in the power supply 111. According to such a configuration, the terminal device 200 can grasp a decrease in the remaining amount of electric power and prompt the user to charge the power supply 111.

The battery information may include information indicating degradation of the power supply 111. As an example, whether the power supply 111 is degraded may be determined based on a state of health (SOH). In this case, the controller 116 determines that the power supply 111 is degraded is the ratio of the current full charge capacity to the initial full charge capacity of 100% decreases to a predetermined threshold value or less. As another example, whether the power supply 111 is degraded may be determined based on cycle counting. In this case, the controller 116 counts one cycle each time the cumulative value of the charging current reaches the full charge capacity, and determines that the power supply 111 is degraded if the count exceeds a predetermined threshold value. If it is determined that the power supply 111 is degraded, battery information including information indicating the degradation of the power supply 111 is transmitted. According to such a configuration, the terminal device 200 can grasp the degradation of the power supply 111 and prompt the user to take measures against the degradation of the power supply 111.

The battery information may be transmitted at a timing at which the connection between the inhaler device 100 and the terminal device 200 is established. As an example, before the start of heating by the heater 121, for example, at a timing at which the state of the lid 14 is changed from the closed state to the open state, the connection may be established, and the battery information may be transmitted. According to such a configuration, the user can be notified of the state of the power supply 111 before heating the stick substrate 150. As another example, at the start timing of charging of the power supply 111, the connection may be established, and the battery information may be transmitted. According to such a configuration, the user can be notified of the state of the power supply 111 before charging.

The battery information may be transmitted at a timing before disconnection of the connection between the inhaler device 100 and the terminal device 200. As an example, after the end of heating by the heater 121, for example, at a timing at which the state of the lid 14 is changed from the open state to the closed state, the battery information may be transmitted. According to such a configuration, the user can be notified of the state of the power supply 111 after heating the stick substrate 150. As another example, at the end timing of charging of the power supply 111, the battery information may be transmitted. According to such a configuration, the user can be notified of the state of the power supply 111 after charging.

The inhaler device 100 may notify the user of the battery information by using the notifier 113. According to such a configuration, the user can be notified of the state of the power supply 111 by using the inhaler device 100 alone.

(8) Log Information

The inhaler device 100 stores log information in the memory 114. The log information is information that is acquired in accordance with use of the inhaler device 100 by the user and is stored in the memory 114. The inhaler device 100 transmits the log information stored in the memory 114 to the terminal device 200. It is assumed that the inhaler device 100 and the terminal device 200 are not always connected to each other. Therefore, the inhaler device 100 stores the log information while not being connected to the terminal device 200, and transmits the stored log information at a timing of being connected to the terminal device 200.

The terminal device 200 transfers the log information received from the inhaler device 100 to another device. An example of another device is a server that provides a service related to the inhaler device 100. The server collects and analyzes the log information, and uses the log information for services such as update of firmware of the inhaler device 100.

Information Acquired During Heating Session

The log information may include information acquired during a heating session, that is, a single heating session. If heating by the heater 121 is performed, the memory 114 stores information acquired during the heating session as the log information. According to such a configuration, the situation during the heating session can be grasped later.

The information acquired during the heating session may include information for identifying the heating session. An example of the information for identifying the heating session is inhalation start time information indicating a time of a first puff in the heating session, that is, a time of a first puff after the start of heating. According to such a configuration, the interval between heating sessions and the number of heating sessions per day can be grasped later.

The information acquired during the heating session may include information indicating a factor by which heating by the heater 121 is permitted. The information indicating a factor by which heating is permitted includes any of information indicating that heating is permitted by the first lock function, information indicating that heating is permitted by the second lock function, or information indicating that the first lock function and the second lock function are invalid. The information indicating a factor by which heating is permitted includes the information indicating that heating is permitted by the first lock function if heating is performed because the lock is released by, in a state in which the first lock function is valid, the operation corresponding to the operation pattern set for the first lock function. The information indicating a factor by which heating is permitted includes the information indicating that heating is permitted by the second lock function if heating is performed because the lock is released by, in a state in which the second lock function is valid, the inhaler device 100 and the terminal device 200 communicating with each other. The information indicating a factor by which heating is permitted includes the information indicating that the first lock function and the second lock function are invalid if heating is performed in a state in which both the first lock function and the second lock function are invalid. According to such a configuration, an analysis regarding use of the first lock function and the second lock function is enabled.

The information acquired during the heating session may include the duration of the heating session. According to such a configuration, the duration of the heating session can be grasped later.

The information acquired during the heating session may include information indicating the number of puffs taken during the heating session. According to such a configuration, the number of puffs taken during the heating session can be grasped later.

The information acquired during the heating session may include information indicating the time of a puff taken during the heating session. A plurality of puffs may be taken during the heating session, in which case the information acquired during the heating session includes information indicating the time at which each of one or more puffs is taken during the heating session. According to such a configuration, the timing of the puff or puffs taken during the heating session can be grasped later.

The information acquired during the heating session may include information indicating the degradation state of the power supply 111 during the heating session. The information indicating the degradation state of the power supply 111 may be, for example, the ratio of the current full charge capacity to the initial full charge capacity of 100%, or may be the number of times the cumulative value of the charging current reaches the full charge capacity. According to such a configuration, the transition of the degradation state can be grasped later.

Information Indicating Operation History

The log information may include information indicating an operation history of the inhaler device 100. According to such a configuration, the history of operations of the inhaler device 100 so far can be grasped later.

The information indicating the operation history may include the cumulative total of the time during which the heater 121 performs heating after the inhaler device 100 has been activated for the first time. According to such a configuration, the duration of heating by the heater 121 in the entire life cycle of the inhaler device 100 can be grasped.

The information indicating the operation history may include the time elapsed after the inhaler device 100 has been activated for the first time. According to such a configuration, the duration of the entire life cycle of the inhaler device 100 can be grasped.

The information indicating the operation history may include the cumulative total of the number of times the heater 121 performs heating after the inhaler device 100 has been activated for the first time. According to such a configuration, the number of times of heating in the entire life cycle of the inhaler device 100 can be grasped.

The information indicating the operation history may include the history of errors that have occurred after the inhaler device 100 has been activated for the first time. According to such a configuration, the errors that have occurred in the entire life cycle of the inhaler device 100 can be grasped.

Information Indicating Remaining Amount of Electric Power

The log information may include information indicating the remaining amount of electric power of the power supply 111. The memory 114 stores, as the log information, information indicating the remaining amount of electric power, included in the battery information acquired to be transmitted to the terminal device 200. According to such a configuration, the transition of the remaining amount of electric power of the power supply 111 can be grasped later.

Information Acquired During Charging

The log information may include information acquired during charging of the power supply 111. If the power supply 111 is charged, the memory 114 stores, as the log information, information acquired during charging of the power supply 111.

An example of the information acquired during charging is information indicating the time at the start of charging and information indicating the remaining amount of electric power at the start of charging. Another example of the information acquired during charging is information indicating the time at the end of charging and information indicating the remaining amount of electric power at the end of charging. According to such a configuration, the history of charging by the user can be grasped.

Timing of Transmitting Log Information

The timing at which the inhaler device 100 transmits the log information may be controlled by the terminal device 200. Specifically, the terminal device 200 transmits, to the inhaler device 100, a log request for requesting execution of a process of transmitting the log information. The inhaler device 100 performs the process requested in the received log request. For example, the terminal device 200 transmits a log request for requesting transmission of the log information to the inhaler device 100, and the inhaler device 100 that has received the log request transmits the log information. According to such a configuration, the inhaler device 100 can transmit the log information at an appropriate timing under the control of the terminal device 200.

(9) State Information

The inhaler device 100 transmits state information indicating the state of the inhaler device 100 to the terminal device 200. According to such a configuration, the terminal device 200 can grasp the state of the inhaler device 100 in real time based on the received state information.

Information Indicating State of Heater 121

The state information may include information indicating the state of the heater 121. In particular, the state information may include information indicating the progress of heating by the heater 121. During the heating session, the inhaler device 100 transmits the state information indicating the progress of heating by the heater 121. According to such a configuration, the terminal device 200 can grasp the state of the heater 121 during the heating session in real time based on the state information.

As an example, the state information may include information indicating that heating by the heater 121 has started. The inhaler device 100 transmits the state information at the start timing of heating based on the heating profile.

As another example, the state information may include information indicating that pre-heating has ended, that is, that the puffing-allowed period has started. For example, the inhaler device 100 transmits the state information at a timing at which a predetermined time has elapsed after the start of heating based on the heating profile.

As another example, the state information may include information indicating a timing that is a predetermined time before the end of the puffing-allowed period. For example, the inhaler device 100 transmits the state information at the end timing of electric power supply to the heater 121.

As another example, the state information may include information indicating that the puffing-allowed period has ended. For example, the inhaler device 100 transmits the state information at a timing at which a predetermined time has elapsed after the end of electric power supply to the heater 121.

Information Indicating State of Lid 14

The state information may include information indicating the state of the lid 14. As an example, the state information may include information indicating that the state of the lid 14 is the open state or the closed state. At a timing at which the state of the lid 14 is changed, the inhaler device 100 transmits the state information indicating the changed state of the lid 14. According to such a configuration, the terminal device 200 can grasp the state of the lid 14 in real time based on the state information.

Information Indicating Charging State of Power Supply 111

The state information may include information indicating a charging state of the power supply 111. As an example, the state information may include information indicating the ratio of the current charge amount to the full charge capacity of the power supply 111. During charging, the inhaler device 100 can transmit the state information including information indicating the charging state of the power supply 111. According to such a configuration, the terminal device 200 can grasp the charging state of the power supply 111 in real time based on the state information.

(10) Timing of Transmitting Log Information

The controller 116 controls the communicator 115 to transmit the log information stored in the memory 114, during a period in which the heater 121 is not allowed to perform heating. That is, the inhaler device 100 transmits the log information during a period in which the heater 121 is not allowed to perform heating. On the other hand, the inhaler device 100 does not transmit the log information during a period in which the heater 121 is allowed to perform heating. Since the log information is temporarily stored in the memory 114 and can be transmitted at any timing later, it can be said that the priority of the process of transmitting and receiving the log information is lower than the priority of the process in which the heater 121 heats the stick substrate 150. In this respect, according to such a configuration, transmission and reception of the log information can be prevented from interfering with the process in which the heater 121 heats the stick substrate 150.

The inhaler device 100 may transmit the log information after at least a first predetermined time has elapsed after the end of the period in which the heater 121 is allowed to perform heating. According to such a configuration, a margin corresponding to the first predetermined time is provided between the end of the period in which the heater 121 is allowed to perform heating and transmission of the log information. Therefore, transmission and reception of the log information can be more reliably prevented from interfering with the process in which the heater 121 heats the stick substrate 150.

The period in which the heater 121 is allowed to perform heating may end at a timing at which the lid 14 closes the opening 142. As described above with respect to the third lock function, this is because, at the timing at which the lid 14 closes the opening 142, the heater 121 is no longer allowed to perform heating, and heating is prohibited in order to prevent dry burning. Therefore, the inhaler device 100 transmits the log information after at least the first predetermined time has elapsed after closing of the opening 142 by the lid 14. According to such a configuration, transmission and reception of the log information can be more reliably prevented from interfering with the process in which the heater 121 heats the stick substrate 150.

The period in which the heater 121 is allowed to perform heating may start at a timing at which the lid 14 opens the opening 142. Alternatively, the period in which the heater 121 is allowed to perform heating may start at a timing at which the lock is released. Alternatively, the period in which the heater 121 is allowed to perform heating may start at the start timing of heating based on the heating profile. According to such a configuration, transmission and reception of the log information can be prevented from interfering with the process in which the heater 121 heats the stick substrate 150.

During the period in which the heater 121 is allowed to perform heating, the inhaler device 100 transmits state information including information indicating the state of the heater 121. For example, the inhaler device 100 starts transmission of the state information including information indicating the state of the heater 121 from the start timing of pre-heating. Since the log information is not transmitted during the period in which the heater 121 is allowed to perform heating, the state information can be transmitted without delay.

The setting of the inhaler device 100 may be changed during a period in which the heater 121 is not allowed to perform heating. In this case, the inhaler device 100 transmits the log information after completion of the setting based on the setting information. Since the log information is temporarily stored in the memory 114 and can be transmitted at any timing later, it can be said that the priority of the process of transmitting and receiving the log information is lower than the priority of the process of performing setting based on the setting information. In this respect, according to such a configuration, transmission and reception of the log information can be prevented from interfering with the process of performing setting based on the setting information.

The inhaler device 100 transmits the log information after at least a second predetermined time has elapsed after completion of the setting based on the setting information. According to such a configuration, a margin corresponding to the second predetermined time is provided between completion of the setting based on the setting information and transmission of the log information. Therefore, transmission and reception of the log information can be more reliably prevented from interfering with the process of performing setting based on the setting information. The timing at which the counting of the second predetermined time starts is not limited to the timing of completion of the setting based on the setting information, and may be the timing of reception of the setting information or the timing of transmission of a setting completion notification.

Here, the first predetermined time and the second predetermined time are different from each other. More specifically, the first predetermined time is longer than the second predetermined time. This is because, after the end of the period during which the heater 121 is allowed to perform heating, the setting information is received, and the setting based on the setting information is performed, and then the log information is transmitted.

As described above, the timing at which the inhaler device 100 transmits the log information may be controlled by the terminal device 200. This point will be described in detail below.

The terminal device 200 transmits a log request (hereinafter also referred to as a first log request) for requesting transmission of the log information. Upon receiving the first log request, the inhaler device 100 transmits the log information. Then, the terminal device 200 receives the log information. According to such a configuration, the inhaler device 100 can transmit the log information at an appropriate timing.

Upon receiving the first log request, the inhaler device 100 may transmit log information yet to be transmitted, included in the log information stored in the inhaler device 100. For this purpose, the inhaler device 100 may store the log information in association with information indicating whether the log information has been transmitted or is yet to be transmitted. Alternatively, the inhaler device 100 may store log information yet to be transmitted and delete the log information once it has been transmitted. According to such a configuration, the transmitted log information can be prevented from being transmitted again.

The terminal device 200 may transmit a log request (hereinafter also referred to as a second log request) for requesting transmission of information indicating the number of pieces of the log information yet to be transmitted. Upon receiving the second log request, the inhaler device 100 transmits the information indicating the number of pieces of the log information yet to be transmitted. Then, the terminal device 200 receives the information indicating the number of pieces of the log information yet to be transmitted, and transmits the first log request. According to such a configuration, the terminal device 200 can transmit the first log request after grasping the number of pieces of the log information stored in the inhaler device 100 and yet to be transmitted.

If the number of pieces of the log information yet to be transmitted is two or more, the first log request includes information specifying one piece of log information to be transmitted among the plurality of pieces of the log information yet to be transmitted. Then, the terminal device 200 transmits the first log request, and the inhaler device 100 transmits the log information specified in the first log request. This is repeated by the number of pieces of the log information yet to be transmitted. As a specific example, an example is assumed in which the inhaler device 100 stores first log information and second log information as the log information yet to be transmitted. In this case, the terminal device 200 transmits the first log request for requesting transmission of the first log information among the plurality of pieces of the log information yet to be transmitted. Upon receiving the first log request for requesting transmission of the first log information, the inhaler device 100 transmits the first log information. After receiving the first log information, the terminal device 200 transmits the first log request for requesting transmission of the second log information. Upon receiving the first log request for requesting transmission of the second log information, the inhaler device 100 transmits the second log information. According to such a configuration, the inhaler device 100 can sequentially transmit the plurality of pieces of the log information yet to be transmitted. Therefore, for example, even if the process of transmitting the plurality of pieces of the log information yet to be transmitted is interrupted before completion, it is possible to easily resume the transmission process from the interrupted point.

If the number of pieces of the log information yet to be transmitted is two or more, the inhaler device 100 transmits the pieces of the log information in an order from a piece with the earliest time of acquisition. That is, in the inhaler device 100, the time of acquisition of the first log information is earlier than the time of acquisition of the second log information. Depending on the storage capacity of the inhaler device 100, the pieces of the log information stored in the inhaler device 100 can be deleted in an order from a piece with the earliest time. In this respect, according to such a configuration, the pieces of the log information can be transmitted in an order from a piece having the highest risk of being deleted.

The log information includes the inhalation start time information as the information indicating the time of acquisition of the log information. Therefore, the terminal device 200 transmits the pieces of the log information in an order from a piece with the earliest time indicated by the inhalation start time information. According to such a configuration, the terminal device 200 can grasp the time of acquisition of the log information with reference to details of the log information, and can transmit the pieces of the log information from a piece with the earliest time of acquisition.

If the lid 14 closes the opening 142, the inhaler device 100 transmits state information including information indicating that the lid 14 has closed the opening 142. After receiving the state information including the information indicating that the lid 14 has closed the opening 142, the terminal device 200 transmits the first log request. In particular, after the first predetermined time has elapsed after receiving the state information including the information indicating that the lid 14 has closed the opening 142, the terminal device 200 transmits the first log request. The same desirably applies to the second log request. Therefore, the inhaler device 100 can transmit the log information after at least the first predetermined time has elapsed after closing of the opening 142 by the lid 14. As described above, by transmitting a log request using the state information as a trigger, the timing of transmitting the log information can be controlled appropriately.

To change the setting of the inhaler device 100, the terminal device 200 transmits the setting information. Upon completing the setting based on the setting information, the inhaler device 100 transmits, to the terminal device 200, a setting completion notification indicating that the setting has been completed. After receiving the setting completion notification, the terminal device 200 transmits the first log request. In particular, after the second predetermined time has elapsed after receiving the setting completion notification, the terminal device 200 transmits the first log request. The same desirably applies to the second log request. Therefore, the inhaler device 100 can transmit the log information after at least the second predetermined time has elapsed after completing the setting based on the setting information. As described above, by transmitting a log request using the setting completion notification as a trigger, the timing of transmitting the log information can be controlled appropriately.

(11) Process Flow

Overall Process Related to Heating Session

Figure 5:
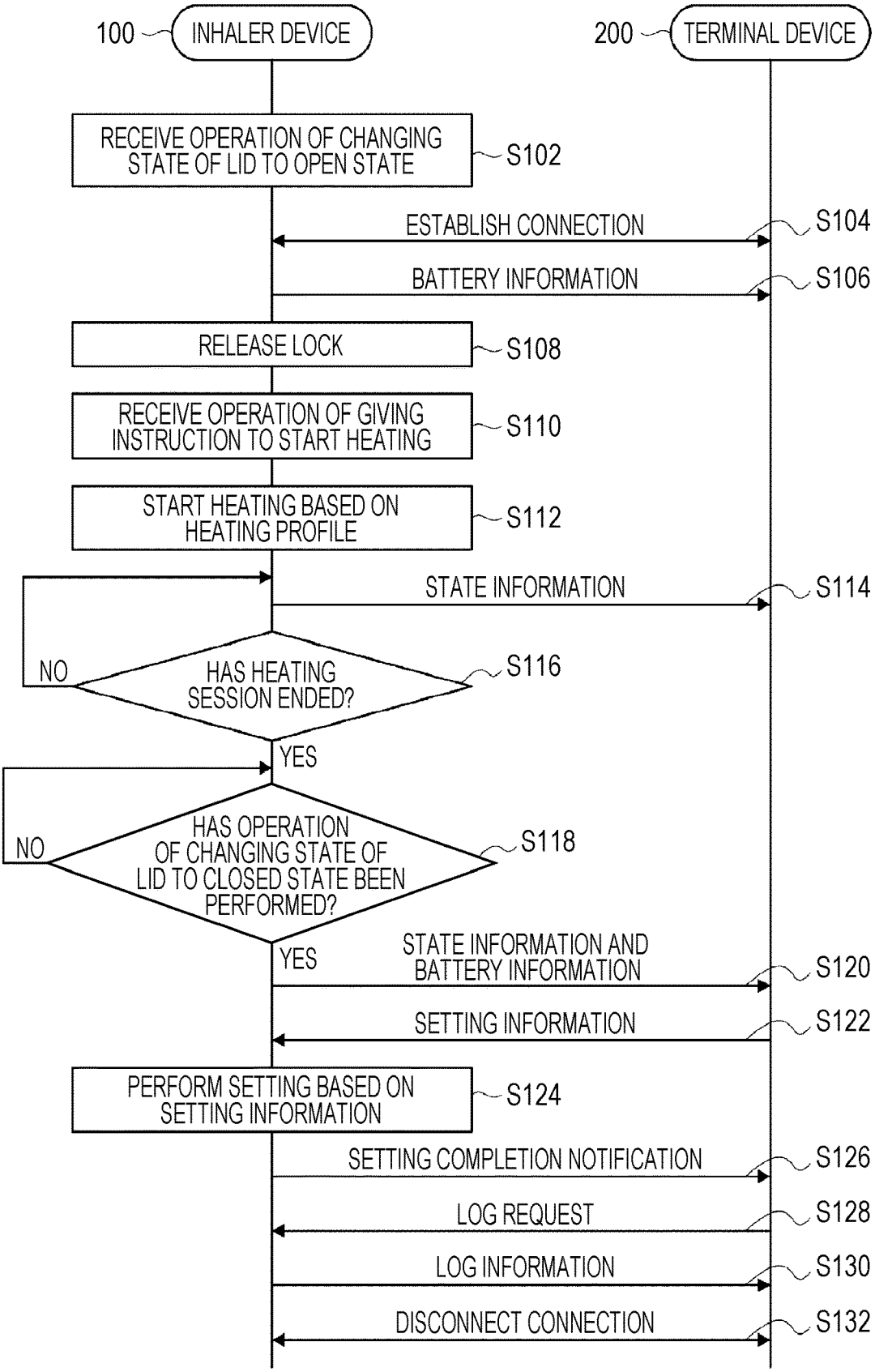
FIG. 5 is a sequence diagram illustrating an example of a flow of an overall process related to a heating session performed in the system according to the present embodiment.

FIG. 5 is a sequence diagram illustrating an example of a flow of an overall process related to a heating session performed in the system 1 according to the present embodiment. This sequence involves the inhaler device 100 and the terminal device 200.

As illustrated in FIG. 5, first, the inhaler device 100 receives an operation of changing the state of the lid 14 to the open state (step S102).

Subsequently, the inhaler device 100 and the terminal device 200 establish a connection (step S104). For example, the inhaler device 100 transmits an advertisement, and the inhaler device 100 and the terminal device 200 that has received the advertisement perform a procedure for establishing the connection.

Subsequently, the inhaler device 100 transmits battery information to the terminal device 200 (step S106).

Subsequently, the inhaler device 100 releases the lock (step S108). For example, the inhaler device 100 releases the lock because the state of the lid 14 is the open state and the communication with the terminal device 200 is being performed, with respect to the second lock function.

Subsequently, the inhaler device 100 receives an operation of giving an instruction to start heating (step S110).

Subsequently, the inhaler device 100 starts heating based on the heating profile (step S112).

Subsequently, the inhaler device 100 transmits state information including information indicating the state of the heater 121 to the terminal device 200 (step S114).

Subsequently, the inhaler device 100 determines whether the heating session has ended (step S116). For example, the inhaler device 100 determines that the heating session has ended if the elapsed time from the start of heating based on the heating profile exceeds a predetermined threshold value. Alternatively, the inhaler device 100 determines that the heating session has ended if the number of puffs taken during the heating session reaches the predetermined upper limit value. If it is determined that the heating session has not ended (step S116: NO), the process returns to step S114 again.

If it is determined that the heating session has ended (step S116: YES), the inhaler device 100 determines whether an operation of changing the state of the lid 14 to the closed state has been performed (step S118). If it is determined that the operation of changing the state of the lid 14 to the closed state has not been performed (step S118: NO), the inhaler device 100 waits until the operation of changing the state of the lid 14 to the closed state is performed.

If it is determined that the operation of changing the state of the lid 14 to the closed state has been performed (step S118: YES), the inhaler device 100 transmits state information including information indicating that the state of the lid 14 has been changed to the closed state, and battery information to the terminal device 200 (step S120).

Subsequently, the terminal device 200 transmits setting information to the inhaler device 100 (step S122). Subsequently, upon receiving the setting information, the inhaler device 100 performs setting based on the received setting information (step S124). Subsequently, the inhaler device 100 transmits a setting completion notification to the terminal device 200 (step S126). Note that the process related to steps S122 to S126 is skipped in a case where a user input for changing the setting of the inhaler device 100 is not performed on the terminal device 200.

Subsequently, the terminal device 200 transmits, to the inhaler device 100, a log request for requesting transmission of log information (step S128).

Subsequently, upon receiving the log request, the inhaler device 100 transmits the requested log information to the terminal device 200 (step S130). For example, the inhaler device 100 transmits information acquired during the heating session in steps S112 to S116 as the log information.

Subsequently, the inhaler device 100 and the terminal device 200 disconnect the connection (step S132). For example, in a case where an operation performed by the user is not detected for a predetermined time or more and a log request is not received, the inhaler device 100 disconnects the connection with the terminal device 200.

Overall Process Related to Charging

Figure 6:
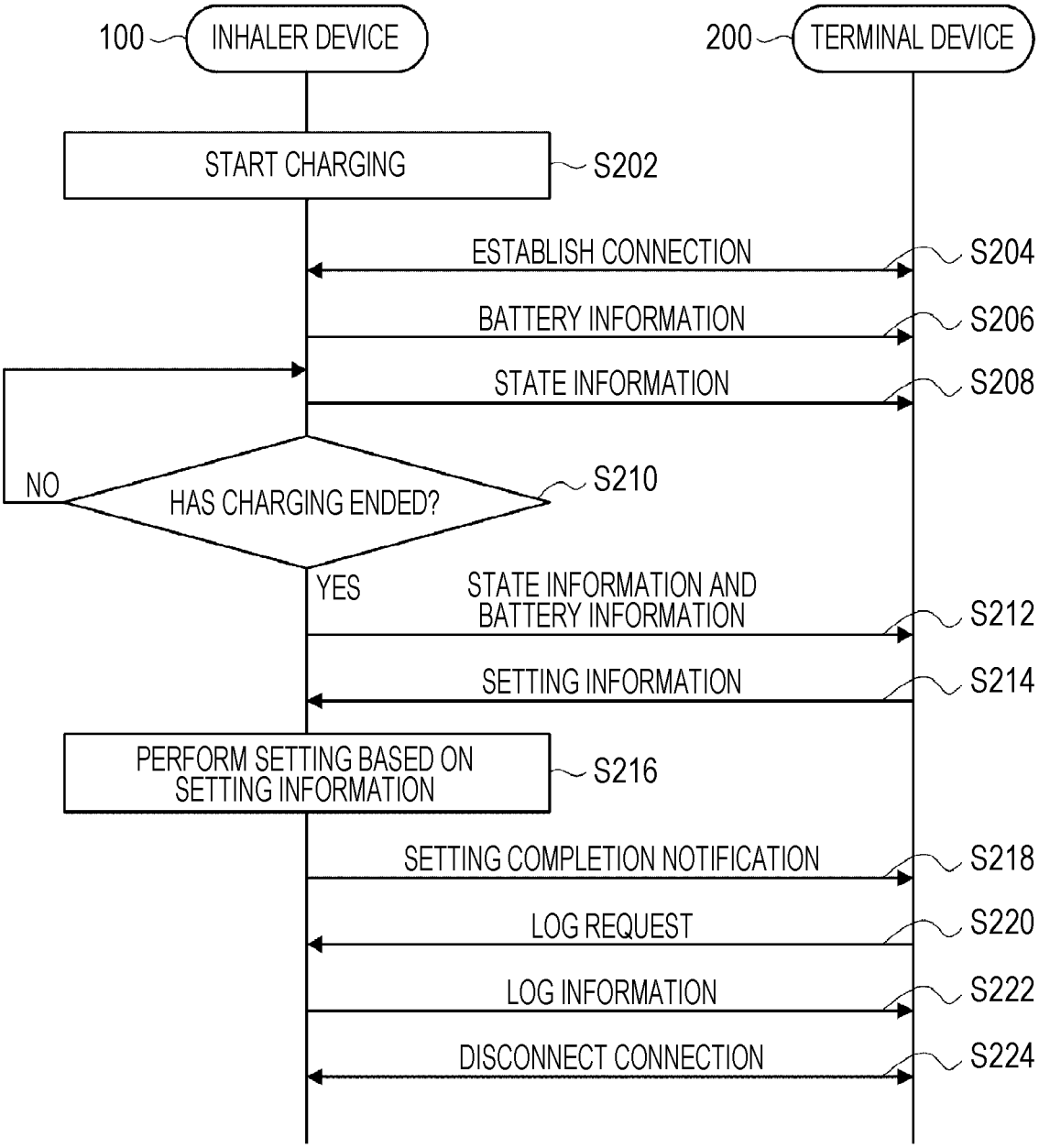
FIG. 6 is a sequence diagram illustrating an example of a flow of an overall process related to charging performed in the system according to the present embodiment.

FIG. 6 is a sequence diagram illustrating an example of a flow of an overall process related to charging performed in the system 1 according to the present embodiment. This sequence involves the inhaler device 100 and the terminal device 200.

As illustrated in FIG. 6, first, the inhaler device 100 starts charging (step S202). The inhaler device 100 starts charging upon being connected to an external power supply.

Subsequently, the inhaler device 100 and the terminal device 200 establish a connection (step S204). For example, the inhaler device 100 transmits an advertisement, and the inhaler device 100 and the terminal device 200 that has received the advertisement perform a procedure for establishing the connection.

Subsequently, the inhaler device 100 transmits battery information to the terminal device 200 (step S206).

Subsequently, the inhaler device 100 transmits state information including information indicating the charging state of the power supply 111 to the terminal device 200 (step S208).

Subsequently, the inhaler device 100 determines whether charging has ended (step S210). If the connection with the external power supply is released, the inhaler device 100 ends charging.

If it is determined that charging has not ended (step S210: NO), the process returns to step S208 again.

If it is determined that charging has ended (step S210: YES), the inhaler device 100 transmits state information including information indicating that the charging state of the power supply 111 and battery information to the terminal device 200 (step S212).

Subsequently, the terminal device 200 transmits setting information to the inhaler device 100 (step S214). Subsequently, upon receiving the setting information, the inhaler device 100 performs setting based on the received setting information (step S216). Subsequently, the inhaler device 100 transmits a setting completion notification to the terminal device 200 (step S218). Note that the process related to steps S214 to S218 is skipped in a case where a user input for changing the setting of the inhaler device 100 is not made on the terminal device 200.

Subsequently, the terminal device 200 transmits, to the inhaler device 100, a log request for requesting transmission of log information (step S220).

Subsequently, upon receiving the log request, the inhaler device 100 transmits the requested log information to the terminal device 200 (step S222). For example, the inhaler device 100 transmits information acquired during the charging in steps S202 to S210 as the log information.

Subsequently, the inhaler device 100 and the terminal device 200 disconnect the connection (step S224). For example, in a case where an operation performed by the user is not detected for a predetermined time or more and a log request is not received, the inhaler device 100 disconnects the connection with the terminal device 200.

Process of Transmitting Log Information Related to Heating Session

Figure 7:
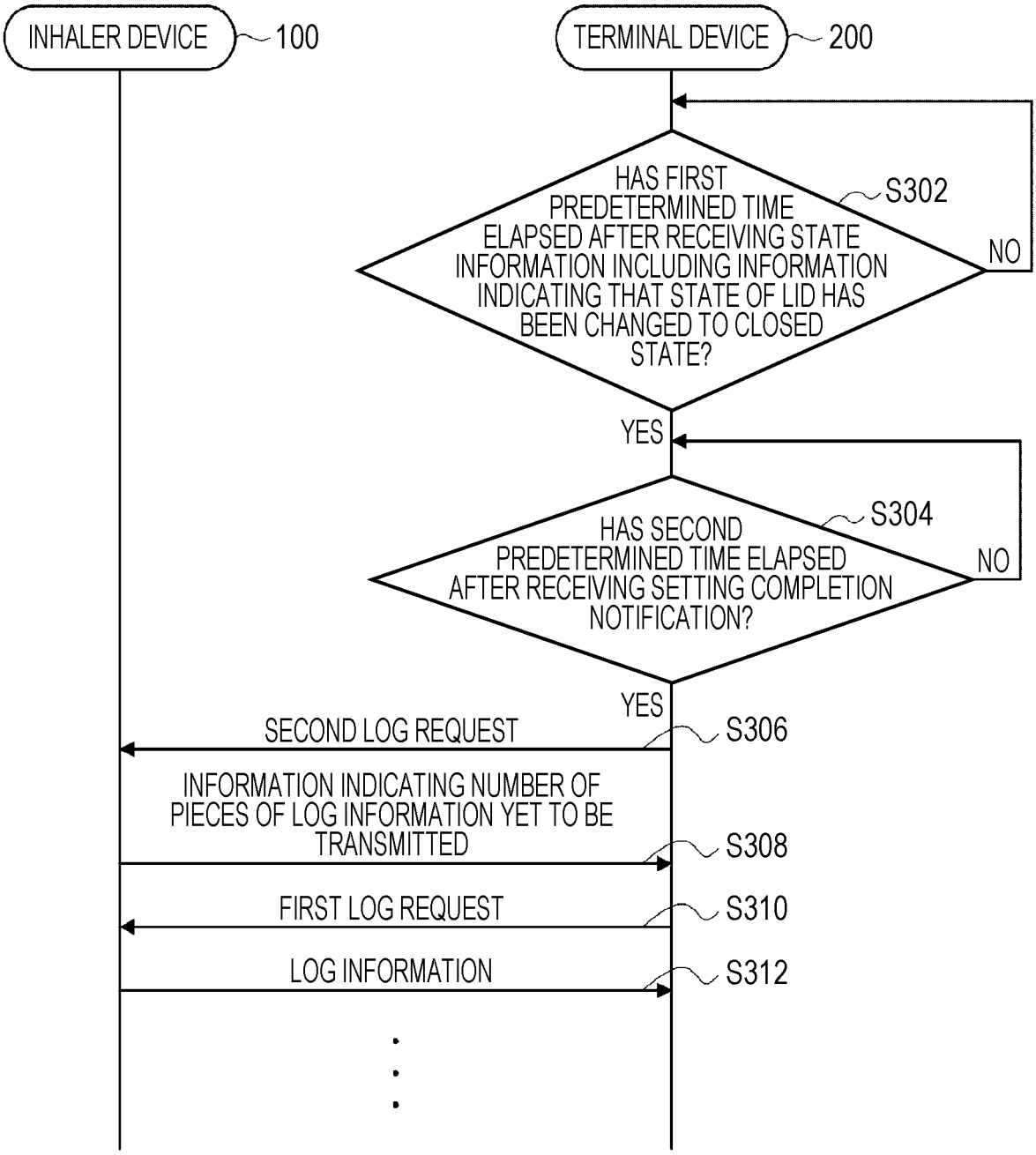
FIG. 7 is a sequence diagram illustrating an example of a flow of a process of transmitting log information related to a heating session performed in the system according to the present embodiment.

FIG. 7 is a sequence diagram illustrating an example of a flow of a process of transmitting log information related to a heating session performed in the system 1 according to the present embodiment. This sequence involves the inhaler device 100 and the terminal device 200. This sequence is a detailed process related to the transmission of the log information in the sequence illustrated in FIG. 5.

As illustrated in FIG. 7, first, the terminal device 200 determines whether the first predetermined time has elapsed after receiving the state information including information indicating that the state of the lid 14 has been changed to the closed state (step S302). If it is determined that the first predetermined time has not elapsed (step S302: NO), the terminal device 200 waits until the first predetermined time elapses.

If it is determined that the first predetermined time has elapsed (step S302: YES), the terminal device 200 determines whether the second predetermined time has elapsed after receiving the setting completion notification (step S304). If it is determined that the second predetermined time has not elapsed (step S304: NO), the terminal device 200 waits until the second predetermined time elapses.

If it is determined that the second predetermined time has elapsed (step S304: YES), the terminal device 200 transmits a second log request to the inhaler device 100 (step S306).

Upon receiving the second log request, the terminal device 200 transmits information indicating the number of pieces of log information yet to be transmitted (step S308).

Upon receiving the information indicating the number of pieces of log information yet to be transmitted, the inhaler device 100 transmits a first log request (step S310). The first log request includes, for example, information for requesting transmission of the earliest piece of the log information among the pieces of the log information yet to be transmitted.

Upon receiving the first log request, the terminal device 200 transmits the log information that has been requested to be transmitted in the first log request (step S312). Here, the inhaler device 100 transmits the log information after the condition determinations in steps S302 and S304 in the terminal device 200. Therefore, the inhaler device 100 can transmit the log information after the first predetermined time has elapsed after closing of the opening 142 by the lid 14 and after the second predetermined time has elapsed after completing the setting based on the setting information.

The terminal device 200 repeatedly performs step S310 as many times as the number of pieces of the log information yet to be transmitted, indicated by the information received in step S308. In response to this, the inhaler device 100 repeatedly performs step S312 to sequentially transmit the pieces of the log information yet to be transmitted, in an order from the earliest time of acquisition.

<<3. Supplementary Notes>>

Although preferred embodiments of the present invention have been described above in detail with reference to the accompanying drawings, the present invention is not limited to such examples. It will be apparent that a person having ordinary skill in the technical field of the present invention will conceive various modifications or variations without departing from the technical thought in the appended claims. It will be appreciated that these modification and variations are also included in the technical scope of the present invention.

For example, the above-described embodiment has described an example in which the terminal device 200 controls the timing of transmitting the log information. However, the present invention is not limited to such an example. For example, the inhaler device 100 may control the timing of transmitting the log information. For example, even if there is no first log request from the terminal device 200, the inhaler device 100 may transmit at least one piece of the log information yet to be transmitted, at a timing of being connected to the terminal device 200. In addition, for example, even if there is no second log request from the terminal device 200, the inhaler device 100 may transmit the information indicating the number of pieces of the log information yet to be transmitted, at a timing of being connected to the terminal device 200. In this case, the inhaler device 100 may transmit the at least one piece of the log information yet to be transmitted, together with the information indicating the number of pieces of the log information yet to be transmitted.

In addition, the sequential processes performed by the devices described in the present specification may be implemented by using any one of software, hardware, and a combination of software and hardware. Programs constituting the software are stored in advance in, for example, recording media (non-transitory media) provided inside or outside the devices. Each program is read into a RAM at the time of execution by a computer and executed by a processor such as a CPU, for example. Examples of the recording media include a magnetic disk, an optical disk, a magneto-optical disk, a flash memory, and the like. Furthermore, the computer programs may be distributed via a network, for example, without using the recording media.

Furthermore, the processes described using the sequence diagrams in the present specification are not necessarily performed in the illustrated order. Some processing steps may be performed in parallel. Also, additional processing steps may be employed, and some processing steps may be skipped.

The following configurations also belong to the technical scope of the present invention.

(1)

A terminal device including:

a communicator that communicates with an inhaler device which heats a substrate containing an aerosol source to generate an aerosol, in which the communicator transmits a first log request for requesting transmission of log information that is acquired in accordance with use of the inhaler device by a user and that is stored in the inhaler device, and receives the log information.

(2)

The terminal device according to (1), in which the communicator receives, from the inhaler device, information indicating a number of pieces of the log information yet to be transmitted, and transmits the first log request.

(3)

The terminal device according to (2), in which the communicator transmits a second log request for requesting transmission of the information indicating the number of pieces of the log information yet to be transmitted, and receives, from the inhaler device, the information indicating the number of pieces of the log information yet to be transmitted.

(4)

The terminal device according to (2) or (3), in which, if the number of pieces of the log information yet to be transmitted is two or more, the communicator transmits the first log request for requesting transmission of first log information among the plurality of pieces of the log information yet to be transmitted, and, after receiving the first log information, transmits the first log request for requesting transmission of second log information.

(5)

The terminal device according to (4), in which a time of acquisition of the first log information in the inhaler device is earlier than a time of acquisition of the second log information.

(6)

The terminal device according to (5), in which the log information includes, as information indicating a time of acquisition of the log information, inhalation start time information indicating a time at which the aerosol is first inhaled in a time segment from a start to an end of a process of generating the aerosol by using the substrate.

(7)

The terminal device according to any one of (1) to (6), in which the inhaler device includes:

an opening through which the substrate is insertable; and a lid that opens and closes the opening, and after receiving state information including information indicating that the lid has closed the opening, the communicator transmits the first log request.

(8)

The terminal device according to (7), in which after a first predetermined time has elapsed after receiving the state information, the communicator transmits the first log request.

(9)

The terminal device according to any one of (1) to (8), in which the communicator transmits setting information for changing setting regarding an operation of the inhaler device, and, after receiving a setting completion notification indicating that the setting based on the setting information has been completed, transmits the first log request.

(10)

The terminal device according to (9), in which after a second predetermined time has elapsed after receiving the setting completion notification, the communicator transmits the first log request.

(11)

The terminal device according to (9) or (10), in which the inhaler device includes a heater that heats the substrate containing the aerosol source to generate the aerosol, the heater operates based on a heating profile defining a time-series transition of a target resistance value, which is a target value of a resistance value of the heater, and the setting information includes information indicating the heating profile.

(12)

The terminal device according to any one of (1) to (11), in which the log information includes information indicating a number of times the aerosol is inhaled in a time segment from a start to an end of a process of generating the aerosol by using the substrate.

(13)

The terminal device according to any one of (1) to (12), in which the log information includes information indicating a time at which the aerosol is inhaled in a time segment from a start to an end of a process of generating the aerosol by using the substrate.

(14)

The terminal device according to any one of (1) to (13), in which the communicator transfers the log information received from the inhaler device to another device.

(15)

An inhaler device including:

a communicator that communicates with another device;

a heater that heats a substrate containing an aerosol source to generate an aerosol; and a memory that stores log information acquired in accordance with use of the inhaler device by a user, in which upon receiving a first log request for requesting transmission of the log information, the communicator transmits the log information.

(16)

The inhaler device according to (15), in which upon receiving the first log request, the communicator transmits the log information yet to be transmitted, included in the log information stored in the memory.

(17)

The inhaler device according to (15) or (16), in which the communicator transmits information indicating a number of pieces of the log information yet to be transmitted.

(18)

The inhaler device according to (17), in which upon receiving a second log request for requesting transmission of the information indicating the number of pieces of the log information yet to be transmitted, the communicator transmits the information indicating the number of pieces of the log information yet to be transmitted.

(19)

The inhaler device according to (18), in which if the number of pieces of the log information yet to be transmitted is two or more, upon receiving the first log request for requesting transmission of first log information among the plurality of pieces of the log information yet to be transmitted, the communicator transmits the first log information, and, upon receiving the first log request for requesting transmission of second log information among the plurality of pieces of the log information yet to be transmitted, the communicator transmits the second log information.

(20)

The inhaler device according to (19), in which if the number of pieces of the log information yet to be transmitted is two or more, the communicator transmits the pieces of the log information in an order from a piece with an earliest time of acquisition.

(21)

The inhaler device according to (20), in which the log information includes, as information indicating a time of acquisition of the log information, inhalation start time information indicating a time at which the aerosol is first inhaled in a time segment from a start to an end of a process of generating the aerosol by using the substrate, and the communicator transmits the pieces of the log information in an order from a piece with an earliest time indicated by the inhalation start time information.

(22)

A non-transitory computer readable medium having a program stored therein, the program for causing a computer to, the computer controlling a terminal device that communicates with an inhaler device which heats a substrate containing an aerosol source to generate an aerosol:

control the terminal device to transmit a first log request for requesting transmission of log information that is acquired in accordance with use of the inhaler device by a user and that is stored in the inhaler device, and receive the log information.

REFERENCE SIGNS LIST

1 system
100 inhaler device
111 power supply
112 sensor
113 notifier
114 memory

115 communicator
116 controller
140 holder
141 internal space
142 opening
143 bottom
144 heat insulator
150 stick substrate
151 substrate
152 inhalation port
11 outer housing
11A top housing
11B bottom housing
12 cover
13 switch
14 lid
15 vent
16 cap
200 terminal device
210 inputter
220 outputter
230 communicator
240 memory
250 controller

The invention claimed is:

1. An inhaler device comprising:

a communicator that communicates with a terminal device paired with the inhaler device;

a heater that heats a substrate containing an aerosol source to generate an aerosol; and a memory that stores log information acquired in accordance with use of the inhaler device by a user, the log information being information relating to operation and status of the inhaler device, wherein upon receiving a first log request received from the terminal device for requesting transmission of the log information, the communicator transmits the log information to the terminal device, and upon receiving a second log request for requesting transmission of information indicating a number of pieces of the log information yet to be transmitted, the communicator transmits the information indicating the number of pieces of the log information yet to be transmitted.

2. The inhaler device according to claim 1, wherein upon receiving the first log request, the communicator transmits the log information yet to be transmitted, included in the log information stored in the memory.

3. The inhaler device according to claim 1, wherein if the number of pieces of the log information yet to be transmitted is two or more, upon receiving the first log request for requesting transmission of first log information among the plurality of pieces of the log information yet to be transmitted, the communicator transmits the first log information, and, upon receiving the first log request for requesting transmission of second log information among the plurality of pieces of the log information yet to be transmitted, the communicator transmits the second log information.

4. The inhaler device according to claim 3, wherein if the number of pieces of the log information yet to be transmitted is two or more, the communicator transmits the pieces of the log information in an order from a piece with an earliest time of acquisition.

5. The inhaler device according to claim 4, wherein the log information includes, as information indicating a time of acquisition of the log information, inhalation start time information indicating a time at which the aerosol is first inhaled in a time segment from a start to an end of a process of generating the aerosol by using the substrate, and the communicator transmits the pieces of the log information in an order from a piece with an earliest time indicated by the inhalation start time information.

6. A non-transitory computer readable medium having a program stored therein, the program for causing a computer to, the computer controlling a terminal device that communicates with an inhaler device which heats a substrate containing an aerosol source to generate an aerosol:

control the terminal device to transmit a first log request to the inhaler device for requesting transmission of log information that is acquired in accordance with use of the inhaler device by a user and that is stored in the inhaler device, and receive the log information transmitted from the inhaler device, wherein the log information is information relating to operation and status of the inhaler device, and control the terminal device to transmit a second log request to the inhaler device for requesting transmission of information indicating a number of pieces of the log information yet to be transmitted, and receive the information indicating the number of pieces of the log information yet to be transmitted.

* * * * *